US005298674A

United States Patent [19]

Yun

[11] Patent Number: 5,298,674

[45] Date of Patent: Mar. 29, 1994

[54] APPARATUS FOR DISCRIMINATING AN AUDIO SIGNAL AS AN ORDINARY VOCAL SOUND OR MUSICAL SOUND

[75] Inventor: Sang-Lak Yun, Suwon, Rep. of Korea

[73] Assignee: SamSung Electronics Co., Ltd., Suwon, Rep. of Korea

[21] Appl. No.: 802,042

[22] Filed: Dec. 3, 1991

[30] Foreign Application Priority Data

Apr. 12, 1991 [KR] Rep. of Korea ..... 1991-5856

[51] Int. Cl.[5] ..... G10H 7/00

[52] U.S. Cl. ..... 84/616; 84/654; 84/DIG. 9; 381/46

[58] Field of Search ..... 84/616, 618, 654, 656, 84/699, DIG. 9; 381/46

[56] References Cited

U.S. PATENT DOCUMENTS

| | | | |
|---|---|---|---|
| 4,377,961 | 3/1983 | Bode . | |
| 4,441,203 | 4/1984 | Fleming | 381/46 X |
| 4,506,379 | 3/1985 | Komatsu . | |
| 4,541,110 | 9/1985 | Hopf et al. | 381/46 |
| 4,690,026 | 9/1987 | McCoy | 84/DIG. 9 |
| 4,692,117 | 9/1987 | Goodwin | 84/DIG. 9 |
| 4,698,842 | 10/1987 | Mackie et al. | 84/DIG. 9 |
| 4,790,014 | 12/1988 | Watanabe et al. | 381/1 |
| 5,065,432 | 11/1991 | Sasaki et al. | 381/61 |
| 5,148,484 | 9/1992 | Kane et al. | 381/46 |
| 5,157,215 | 10/1992 | Nakae et al. | 84/624 |
| 5,210,366 | 5/1993 | Sykes, Jr. | 84/616 |

*Primary Examiner*—William M. Shoop, Jr.
*Assistant Examiner*—Jeffrey W. Donels
*Attorney, Agent, or Firm*—Robert E. Bushnell

[57] ABSTRACT

An apparatus for discriminating a received audio signal as vocal sound or musical sound includes a pre-processing circuit 100 for separating the audio signal into a vocal frequency band signal and a musical frequency band signal, an intermediate decision circuit having a plurality of decision units for producing a plurality of vocal and musical decision signals, each decision unit distinguishing whether vocal or musical frequency band signal includes properties of voice or music, and a final decision circuit 600 for systematically analyzing the vocal and musical decision signals to produce a final decision signal for discriminating the audio signal as the vocal or musical sound.

30 Claims, 18 Drawing Sheets

APPARATUS FOR DISCRIMINATING AN AUDIO SIGNAL AS AN ORDINARY VOCAL SOUND OR MUSICAL SOUND

BACKGROUND OF THE INVENTION

The present invention relates to an apparatus for discriminating an audio signal, and more particularly an apparatus for automatically discriminating the audio signal as either an ordinary vocal sound, e.g., speech, or a musical sound.

A conventional method of discriminating an audio signal comprises the steps of converting the analog form of the audio signal into a digital form, and sensing to discriminate the characteristics of the digital audio signal. Namely, the analog audio signal is converted into a digital signal whose features are analyzed so as to discriminate the audio signal as an ordinary vocal or musical sound. However, this conventional method requires an artificial intelligence device of high cost together with a complicated procedure thereof.

The presently available small-sized video systems such as used for video data processing and cable television, provide audio systems which suffer an inherent limitation in the ability to reproduce audio signals. Such small-sized systems process the vocal and musical parts of the audio signal in the same manner, so that the vocal and musical parts may not be lively and dynamically reproduced. In order to overcome this drawback, if the audio signal represents the vocal sound, the frequency band of the dynamic range is reproduced without modification, while, if the audio signal represents the musical sound, the low and high frequency band parts of the dynamic range are boosted. Then the musical sound is dynamically and lively reproduced.

To this end, the reproduction of the received audio signal must be performed on the basis of a decision signal that is produced to discriminate the audio signal as either an ordinary vocal sound or a musical sound. However, a small-sized system needs a digital processing means of high cost to discriminate the audio signal as ordinary vocal or musical sound, and the digital processing means requires a complicated technology, so that the system occupies a large volume.

SUMMARY OF THE INVENTION

It is an object of the present invention to provide an apparatus for discriminating an audio signal as an ordinary vocal or musical sound in an audio system.

It is another object of the present invention to provide an apparatus comprising a plurality of decision units, each unit discriminating an audio signal as an ordinary vocal or musical sound based on the properties of the vocal and musical sound.

It is still another object of the present invention to provide an apparatus for discriminating an audio signal as an ordinary vocal or musical sound, by comparing a number of indicators of vocal properties sound with a number of indicators of musical sound properties.

It is further another object of the present invention to provide an audio system for dynamically and lively reproducing a musical sound by boosting the low and high frequency band signals of an audio signal indicating the musical sound in the corresponding dynamic range, when the audio signal is discriminated as a musical sound.

According to the present invention, an apparatus for discriminating a received audio signal as an ordinary vocal sound or musical sound, comprises a pre-processing means for separating the audio signal into a vocal frequency band signal and a musical frequency band signal, an intermediate decision means consisting of a plurality of decision units for producing a plurality of vocal and musical decision signals, each of the decision units distinguishing whether the vocal or musical frequency band signal is characterized by one of the properties of the ordinary voice or of the music, and a final decision means for systematically analyzing the vocal and musical decision signals so as to produce a final decision signal for finally discriminating the audio signal as the ordinary vocal or musical sound.

BRIEF DESCRIPTION OF THE ATTACHED DRAWINGS

For a better understanding of the invention, and to show how the same may be carried into effect, reference will be made, by way of example, to the accompanying diagrammatic drawings, in which.

DETAILED DESCRIPTION OF A PREFERRED EMBODIMENT

Figure 1:
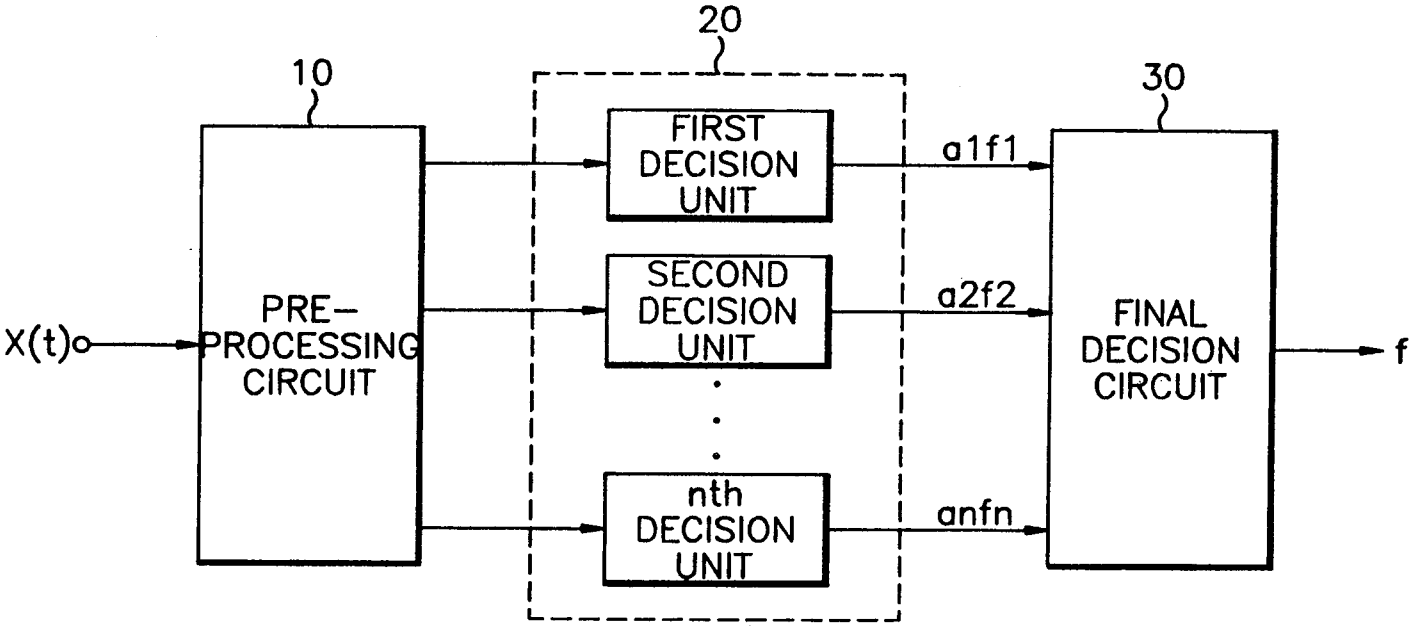
FIG. 1 is a block diagram for illustrating the inventive apparatus.

An apparatus for discriminating an audio signal as an ordinary vocal or musical sound needs decision logic based on empirical electrical parameters rather than a full decision logic in order to easily obtain a satisfactory validity. For example, assuming the parameter f is a coefficient indicating decision factor that the audio signal is the vocal or the musical sound, and a factor x(t) is an input signal, the error function is expressed by the following equation:

$$e(f) = 1 - \lim(t \to 0)\left[\frac{\int [f(x(t)), g(x(t))]dt}{t}\right] \quad (1)$$

Wherein e is an instantaneous error rate expressed by e=1−instantaneous validity, a coefficient δ has a value of 1 when the factors are equal, and a parameter g represents the ordinary vocal or musical sound when the input signal x(t) is discriminated to be the ordinary vocal or musical sound.

In order to realize the reliable parameter f, however, the conventional apparatus should include an artificial intelligence means or neuron network. The reason is that the uncertainty in the range of values of the coefficient g makes it impossible to accurately describe the parameter f.

Therefore, in the apparatus according to the present invention, the parameter f is illustrated by the following functional relation in terms of the factor h:

$$f=h[f1\{x(t)\}, f2\{x(t)\}, f3\{x(t)\}, \ldots fn\{x(t)\}] \quad (2)$$

Wherein f1, f2, f3, . . . , fn are the parameters for representing the properties of the input signal x(t), which are systematically analyzed in order to discriminate the audio signal as the ordinary vocal or musical sound. The expression of the equation (2) changes the parameter f from a normal differentiation form to a partial differentiation form. Although, in many cases, the normal differentiation may be expressed in the form of a linear first order combination of a partial differentiation, the parameter f is not necessary in the linear form. However, since, if the parameter f is non-linear, analysis and adjustment for f are complicated, in the embodiment of the present invention, the parameter f is properly simplified in the linear first order combination, which is effective.

The inventive apparatus for discriminating the audio signal x(t) as the ordinary vocal or musical sound comprises a simplified circuit, thus simplifying the determination of the optimum value of the parameter f.

Hence, the parameter f may be expressed in the linear first order combination of f1, f2, f3, . . . , and fn as follows:

$$f=\frac{a_1\cdot f_1(x(t))+a_2\cdot f_2(x(t))+a_3\cdot f_3(x(t))+\ldots+a_n\cdot f_n(x(t))}{n} \quad (3)$$

Wherein $a_1$ to $a_N$ are real numbers, and the values of $f_1$ to $f_N$ are made to have be one or zero when the audio signal is discriminated as the musical or vocal sound, respectively. That is, since the value of the parameters $f_1$ to $f_N$ has a normalized real value of zero to one, the uncertainty of the coefficient g may be indicated. In this view, the apparatus for discriminating the audio signal as the ordinary vocal or musical sound comprises a number n of decision units for detecting the parameters $f_1$ to $f_N$ representing the inherent properties of the input audio signal, and a final decision circuit for systematically analyzing the signals of the parameters $f_1$ to $f_N$ so as to finally discriminate the audio signal as the musical or vocal sound.

As known in the equation (2), in order to minimize the instantaneous error rate e, the number n of the decision units are preferably increased to a greatest amount. It is also preferable to independently construct each of the decision units for detecting the parameters. If the outputs fx, where X is a number from one to N, of the decision units and the output of the final decision circuit are determined, it is possible to make the linear combination coefficients $a_1$ to $a_N$ simply have optimum values. Since each of the output signals fx from the decision units only represents each characteristic parameter of the inputted audio signal, the instantaneous error rate e(f(X)) may be greatly increased. However, by momentarily driving each of the decision units, may be obtained the values of the linear combination coefficients $a_1$ to $a_N$ required in order to minimize the instantaneous error rate e(f(X)) may be obtained by momentarily driving each of the decision units.

Referring to FIG. 1, a pre-processing circuit 10 separates a received audio signal x(t) into a vocal and musical frequency band signal, and applies the separated audio signal to an intermediate decision circuit 20, which comprises a plurality of decision units for detecting the parameters representing the inherent properties of the audio signal x(t). Each of the decision units independently analyzes the corresponding parameter of the audio signal x(t) so as to produce a decision signal, which is applied to a final decision circuit 30. The final decision circuit 30 systematically analyzes a plurality of the decision signals produced by the decision units so as to discriminate the audio signal as the vocal or musical sound. Thus, the probability of the improper decision resulting from the error rate is minimized.

More specifically describing, the audio signal is separated by means of a plurality of parameters based on the inherent properties of the vocal and musical sound. The intermediate decision circuit 20 comprises a plurality of decision units for independently detecting the parameters corresponding to the inherent properties of the audio signal. Each of the decision units discriminates the audio signal x(t) as the vocal or musical sound, according to the existence of the corresponding parameter.

To this end, the pre-processing circuit 10 modifies the audio signal, for supplying to the decision units. Namely, the pre-processing circuit 10 separates the audio signal x(t) into ordinary vocal and musical frequency band signals. Then, the decision units of the intermediate decision circuit 20 analyze the output of the pre-processing circuit 10, when the corresponding parameters are included therein, discriminating the audio signal as the vocal or musical sound. In this case, each of the decision units only processes the corresponding one of the parameters, and therefore may generate an improper decision signal.

The final decision circuit 30 systematically analyzes the parameter signals received from the intermediate decision circuit 20, so as to discriminate the audio signal as the vocal or musical sound based on the empirically or statically assessed optimum value. Hence, the final decision circuit 30 systematically performs an analog calculation based on the hysteretic and majority rule to finally produce a signal for discriminating the audio signal as the vocal or musical sound with a high dependability, even if the part of the intermediate decision units 20 produces erroneous decision signals. Namely, the intermediate decision circuit 20 comprises a first decision unit for detecting a stereophonic component of the audio signal, a second decision unit for detecting an intensity of the low and high frequency components of the audio signal, a third unit for detecting whether the intensity of the audio signal is continuous or intermittent, and a fourth unit for detecting peak frequency changes of the spectrum of the audio signal.

Figure 2:
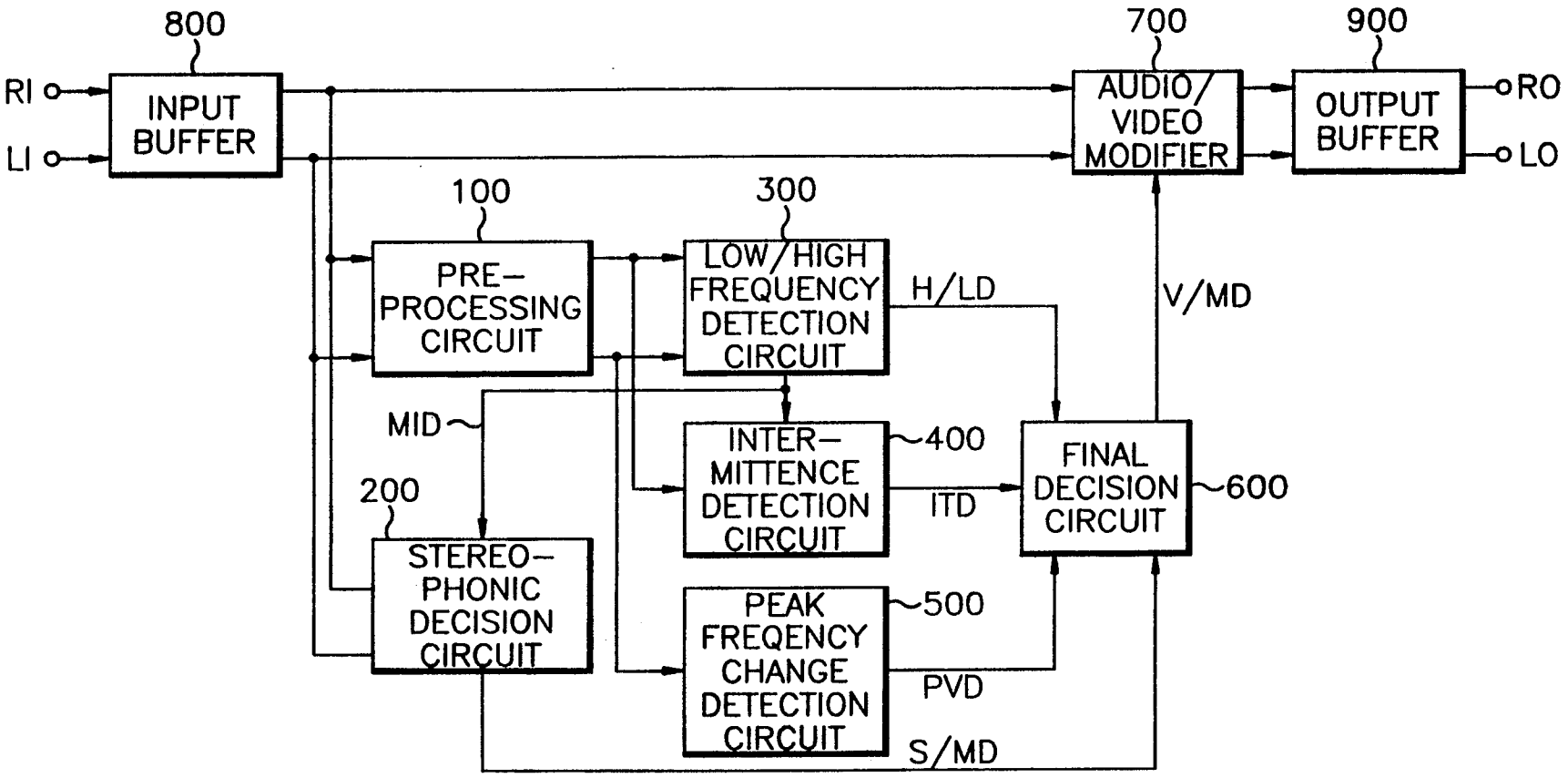
FIG. 2 is a block diagram for more specifically illustrating the apparatus of FIG. 1.

Referring to FIG. 2, an input buffer 800 amplifies an audio signal that is separated into a first processed signal of the ordinary vocal frequency band signal and a second processed signal of the musical frequency band signal.

A stereophonic decision circuit 200 detects the signal of the difference between the left channel signal LI and the right channel signal RI of the audio signal, producing a first decision signal S/MD for discriminating whether the audio signal is the stereophonic or monophonic signal according to a level of a difference. Assuming the audio signal to be stereophonic, the vocal sound signal is loaded simultaneously in the left and right channel, thus producing a monophonic sound signal. However, the musical sound signal is loaded differently in the left and right channel so that the difference signal between the L and R left and right channel means the audio signal to be the musical sound signal. Namely, a stereophonic audio signal being received, the difference between the left and right channel is detected to discriminate the audio signal as the vocal or musical sound, according to the magnitude of the difference. However, if the audio signal is monophonic, there is no difference between the left and right channel, so that it is unnecessary to operate the stereophonic detection circuit 200. For example, if the stereophonic detection circuit 200 is used in a TV system, the carrier signal containing a stereophonic/monophonic signal and multi-voice signal is utilized to switch the stereophonic detection circuit.

A low/high frequency detection circuit 300 detects the difference between the absolute values of the first and second processed signals produced by the pre-processing circuit 100 in order to produce a second decision signal H/LD according to the intensity of the low and high frequency bands of the signals. Namely, whereas the human voice occupies only the medium spectrum portion of the audio signal, the musical sound occupies a wide spectrum portion of the audio signal, so that its intensity is greater than that of the voice in the low and high frequency band. Hence, analyzing the features of the envelopes of the low, medium and high frequency bands filtered, it is possible to discriminate the audio signal as the voice or music sound. However, since simply comparing the low and high frequency signal with a constant magnitude is affected by the input level of the audio signal, the low and high frequency detection circuit 300 needs to compare the low and high frequency band of the audio signal with the medium frequency band of the audio signal in order to avoid the effect of the input level.

An intermittence detection circuit 400 integrates the first processed signal of the pre-processing circuit 100 to check the intermittence or continuity of the envelope thereof so as to produce a third decision signal ITD. The continuity of the envelope is relatively high for the voice signal, and low for the musical signal. Hence, after an absolute value of the first processed signal is obtained through an integrating circuit having two time constants, a difference between a rectified signal of a voice component signal VO produced from the low and high detection circuit and the absolute values, is a differential value of the an envelope. A difference with a long average time will indicate the voice signal. Thus the intermittence detection circuit 400 has a considerably high voice discrimination for the audio signal.

A peak frequency change detection circuit 500 detects peak frequency changes in a bandwidth of a second processed signal produced by the pre-processing circuit 100, therefrom generating a fourth decision signal PVD. The fact that the low and high frequency components of the musical signal are stronger than the frequency component of the voice signal, means the musical signal has a wide bandwidth. Consequently, the wide bandwidth indicates the audio signal to be the musical signal. Further, the peak frequency changes of the music signal are greater than that of the voice signal. Hence, the peak frequency change detection circuit 500 discriminates the audio signal as the musical signal when the audio signal has great peak frequency changes in a wide bandwidth, and as the voice when the audio signal has few peak frequency changes in a narrow band.

A final decision circuit 600 systematically analyzes the first to fourth decision signals S/MD, H/LD, ITD, and PVD to produce a final decision signal V/MD for finally discriminating the audio signal as the music or voice. This circuit 600 makes a decision on the basis of the majority rule, so that if a given number of states opposite to a present output state do not occur, the present state of the output signal is not changed. In addition, a chattering phenomenon occurs in the voice or musical signal when the audio signal exhibits a considerable amount of state changes. In order to prevent the chattering phenomenon, a chattering prevention circuit is provided with the final, decision circuit 600, so that the state changed signal of the voice or musical signal is outputted after a given time delay.

As stated above, the inventive apparatus for discriminating the audio signal as the ordinary vocal sound or musical sound generates a plurality of decision signals according to the inherent properties of the musical and vocal signals which respectively indicate the existence of the stereophonic component, the intensity of the low and high frequency band, the intermittence, bandwidth, and the peak frequency changes in the corresponding bandwidth, of the audio signal. In this case, the decision units may produce an instantaneous error. However, the final decision circuit 600 systematically and in a majority rule, analyzes the decision signals so as to discriminate the audio signal as the ordinary vocal or musical sound. Thus, even if the decision units produce an instantaneous error, the final decision circuit 600 can exactly discriminate the audio signal as the ordinary vocal or musical sound.

An audio/video modifier means 700 utilizes the final decision signal V/MD to boost the low and high frequency bands of the audio signal when the audio signal is discriminated as the musical sound, or to pass the audio signal without modifying when the audio signal is discriminated as the vocal sound. An output buffer 900 amplifies the audio signal outputted from the audio/video modifier means 700. Thus, when the audio signal is discriminated as the musical sound, the low and high frequency band sounds thereof are dynamically reproduced.

Hereinafter, a more specific description will be made of the decision units. It is assumed the audio signal is a stereophonic audio signal including the vocal and musical frequency bands.

Figure 9A:
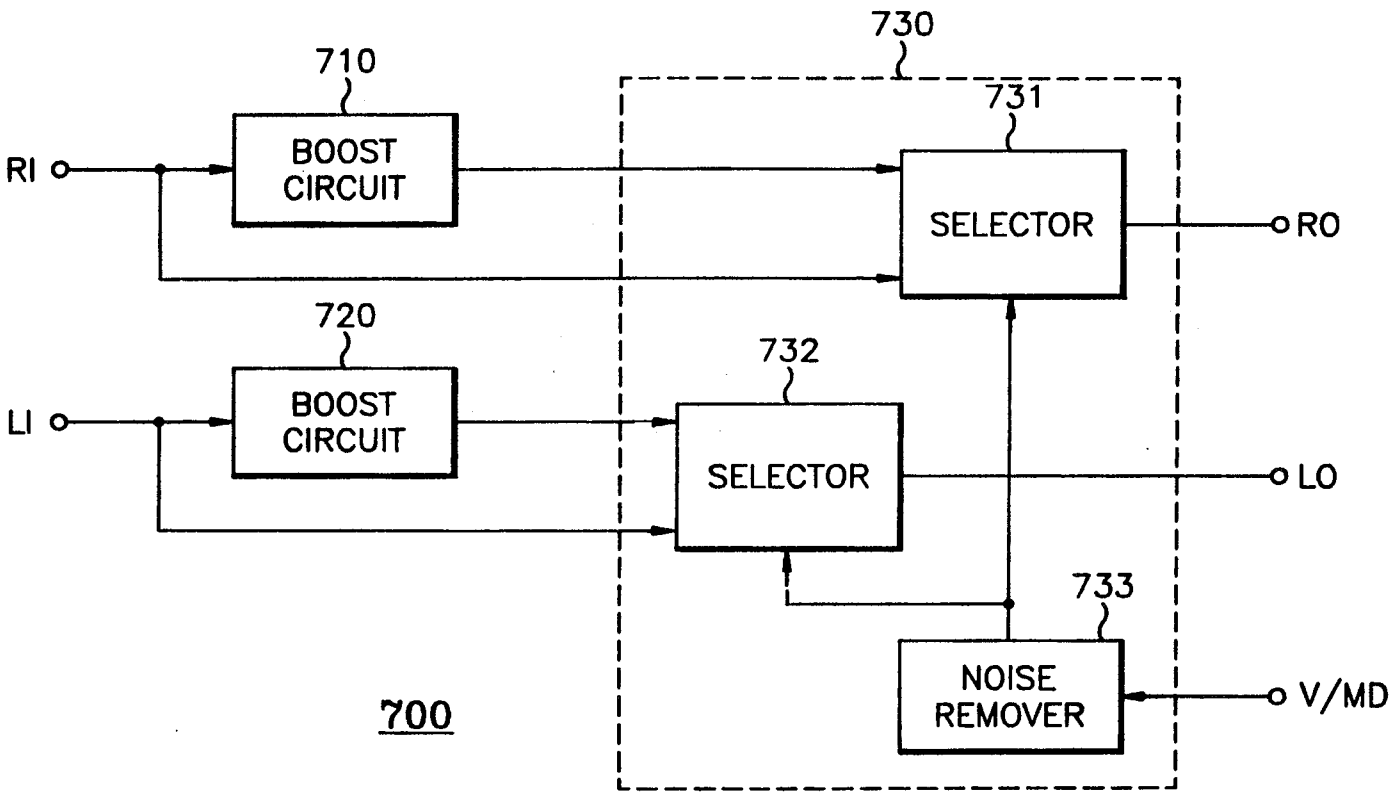
FIG. 9A is a block diagram for illustrating an audio/video modifier means as shown in FIG. 2.
Figure 9B:
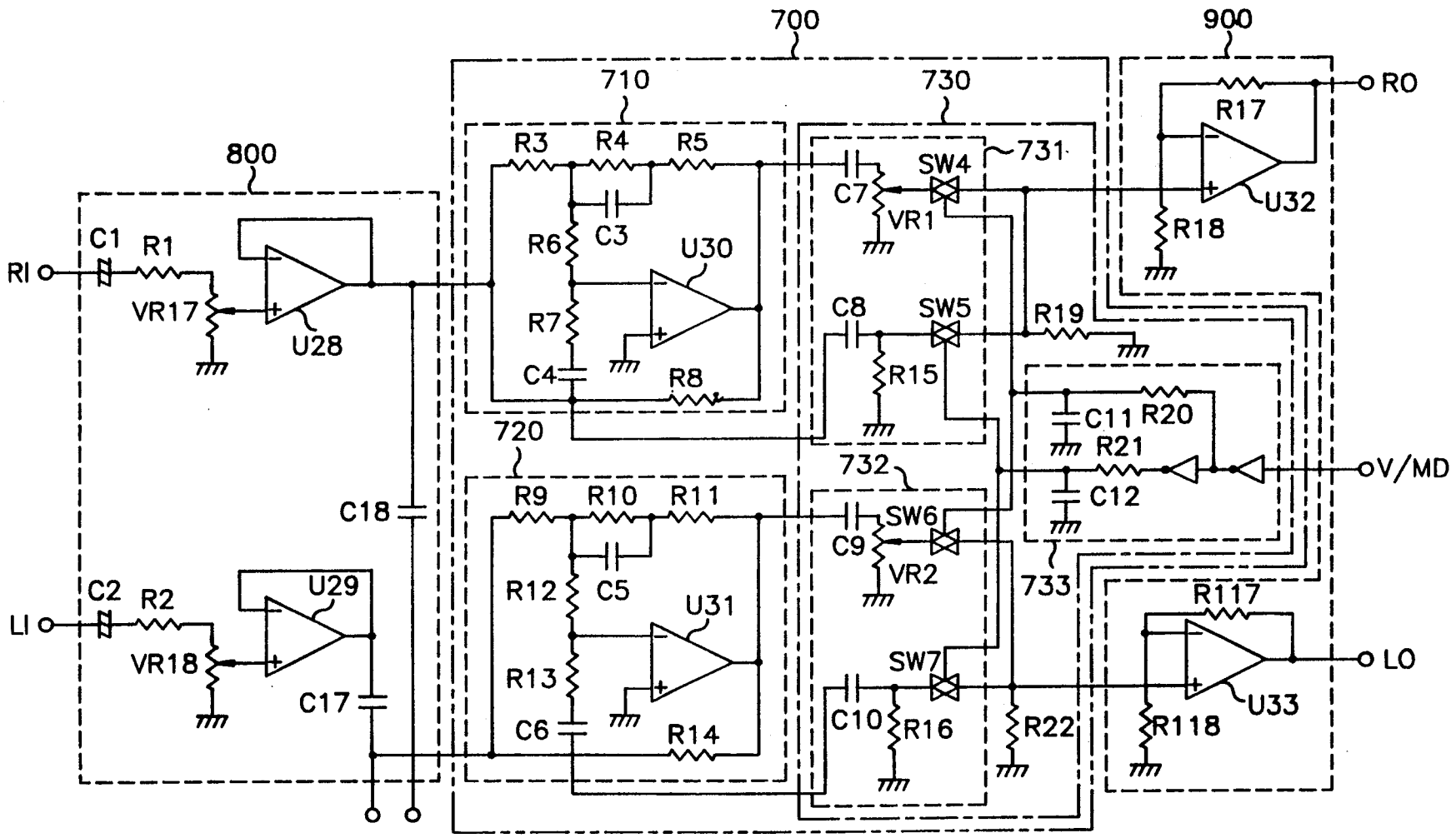
FIG. 9B is a schematic diagram of portions of FIG. 2.

The right and left channel audio signals RI and LI are respectively amplified by the amplifiers U28 and U29 of an input buffer 800 as shown in FIG. 9B.

Figure 3A:
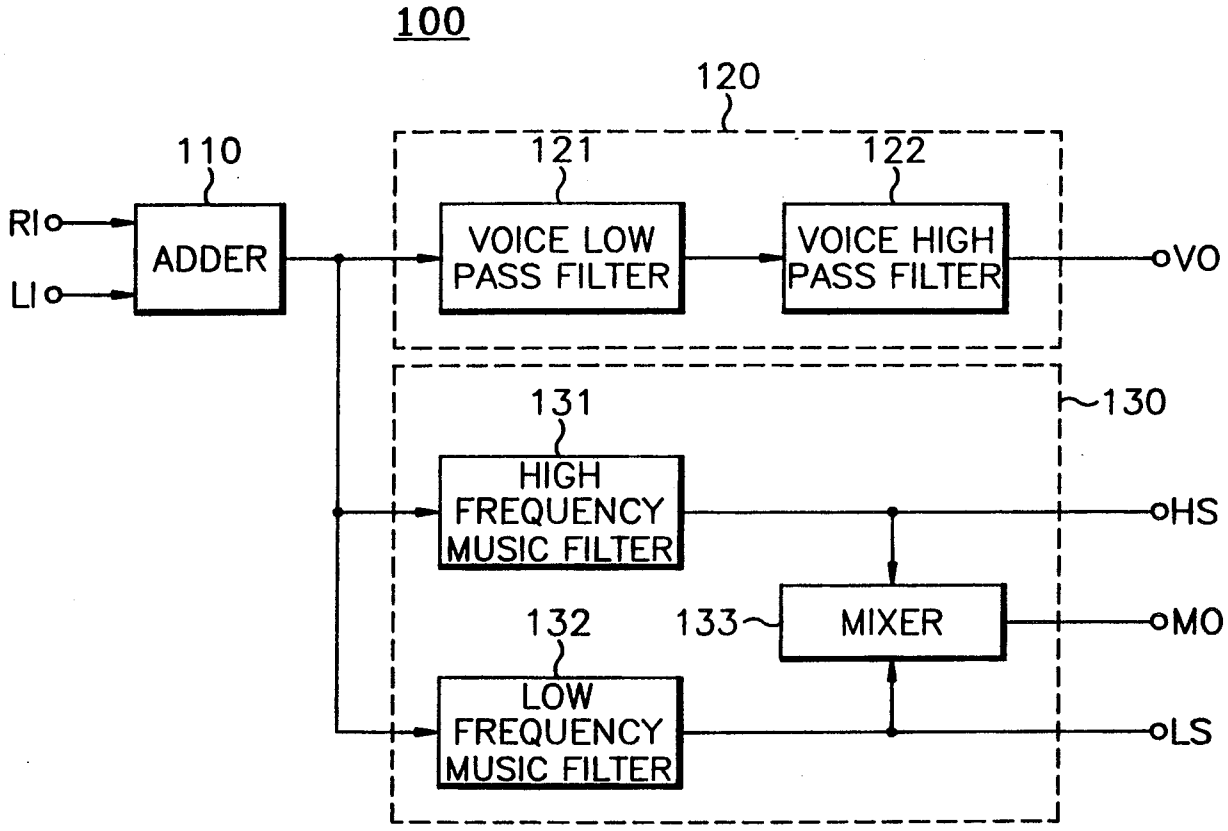
FIG. 3A is a block diagram for illustrating a preprocessing means of FIG. 2.
Figure 3B:
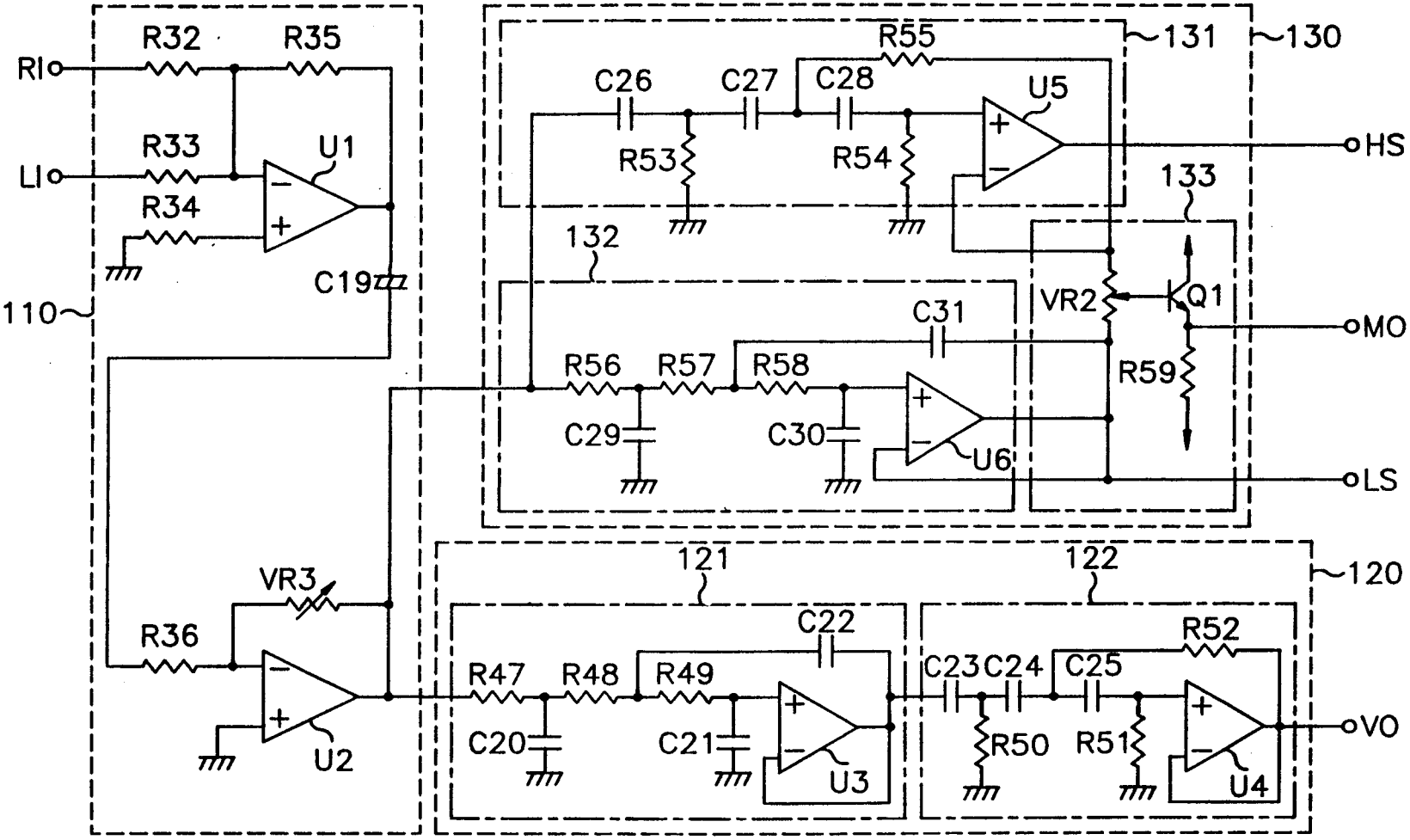
FIG. 3B is a schematic diagram of FIG. 3A.

Referring to FIGS. 3A and 3B, the pre-processing circuit 100 is described. An adder 110 adds and amplifies the two input audio signals RI and LI to generate the audio signals of full frequency band.

A voice component detector 120 detects and passes only the audio signals of the frequency band containing the voice component signal VO from the output of the adder 110. Namely, the voice component detector 120 comprises a voice low pass filter 121 for passing a part of the output of the adder 110 below the maximum frequency of the vocal frequency band, and a voice high pass filter 122 connected in series with the voice low pass filter 121 a passes part of the output of the voice low pass filter 121 above the minimum frequency of the vocal frequency band.

A music component detector 130, except for the frequency band of the voice component signal VO, detects the high frequency music component signal HS, the low frequency music component signal LS from the output of the adder 110, except the frequency band of the voice component signal VO, and the mixed music component signal MO of the two signals HS and LS. Namely, the music component detector 130 comprises a high frequency music filter 131 for passing the high frequency music component signal HS of the output of the adder 110 above the maximum frequency of the voice component signal VO, a low frequency music filter 132 for passing the low frequency music component signal LS of the output of the adder 110 below the minimum frequency of the voice component signal VO, and a mixer 133 for mixing the two music component signals HS and LS produced from the two filters 131 and 132 so as to produce the music component signal MO.

The pre-processing circuit 100 detects, in the whole stereophonic signal band of the audio signals RI and LI, the voice component signal VO occupying the central region and the music component signals HS and LS occupying the left and right side region, respectively, which signals are respectively supplied to the decision units. The adder 110 adds the two signals RI and LI in order to discriminate the audio signal as the music or voice over the full band of the received audio signal. Namely, referring to FIG. 3B, the adder U1 adds the two audio signals RI and LI inputted through resistors R32 and R33. The added signal of an analog form outputted from the adder U1 is amplified by an amplifier U2. Hence, this added signal is the component of the common signal band of the audio signals RI and LI.

Thereafter, the added signal is applied to the voice component detector 120 and music component detector 130. The voice component detector 120 detects the voice component signal VO from the audio signal frequency band. The voice component detector 120 comprises the voice low pass filter 121 for passing the audio signal below the voice frequency band, and the voice high pass filter 122 connected in series with the voice low pass filter for passing the audio signal above the voice frequency band. The voice low pass filter 121 has the cutoff frequency that is the maximum frequency of the vocal frequency band, thereby passing the part of the added signal below the vocal frequency band signal. On the other hand, the voice high pass filter 122 has the cutoff frequency that is the minimum frequency of the vocal frequency band, thereby passing the part of output of the voice low pass filter 121 above the vocal frequency band signal.

The voice component detector 120 may be constructed as shown in FIG. 3B. If the cutoff frequency is determined to be 1.6 KHz by means of a plurality of resistors R47 to R49 and capacitors C20 to C22, the filter U3 passes only the part of the added signal below 1.6 KHZ. Meanwhile, if the cutoff frequency is determined to have 400 Hz by means of a plurality of resistors R50 to R52 and capacitors C23 to C25, the filter U4 passes only the audio signal above 400 Hz. Thus, the finally produced voice component signal VO exists in the vocal frequency band between 400 Hz and 1.6 KHz.

The music component signals existing in the regions outside of the voice component signal VO, are detected as follows. The music high pass filter 131 passes the part of the added signal above the frequency band of the voice component signal VO, while the music low pass filter 132 passes the part of the added signal below the frequency band of the voice component signal VO. Thus the music high pas filter 131 outputs the high frequency music component signal HS, while the music low pass filter 132 outputs the low frequency music component signal LS. In this case, if the cutoff frequency is determined to have 3.2 KHz by meas of a plurality of resistors R53 to R55 and capacitors C26 to C28 as shown in FIG. 3B, the filter U5 passes the part of the added signal above 3.2 KHZ. Meanwhile, if the cutoff frequency is determined to have 200 Hz by means of a plurality of resistors R56 to R58 and capacitors C29 to C31, the filter U6 passes the part of the added signal below 200 Hz. Thus the high frequency music component signal HS is the audio signal above 3.2 KHz, while the low frequency music component signal LS is the audio signal below 200 Hz. The two signals HS and LS obtained by the filters U5 and U6 are mixed through the resistor VR2 to form the music component signal MO. Namely, the mixer 133 mixes the two signals HS and LS. The music component signal MO serves the as a reference signal, to determine if the music component is present.

The pre-processing circuit 100, as described above, separates the voice component audio signal VO and the music component audio signals HS and LS, from the received audio signal. In this case, if the low and high frequency bands of the received audio signal have a high intensity so as to produce the HS and LS signals of a high intensity, the music component signal MO has a high level. However, if the intermediate frequency band of the audio signal has a high intensity, the signals HS and LS have low intensity, and therefore the music component signal MO has a low level level.

Figure 4A:
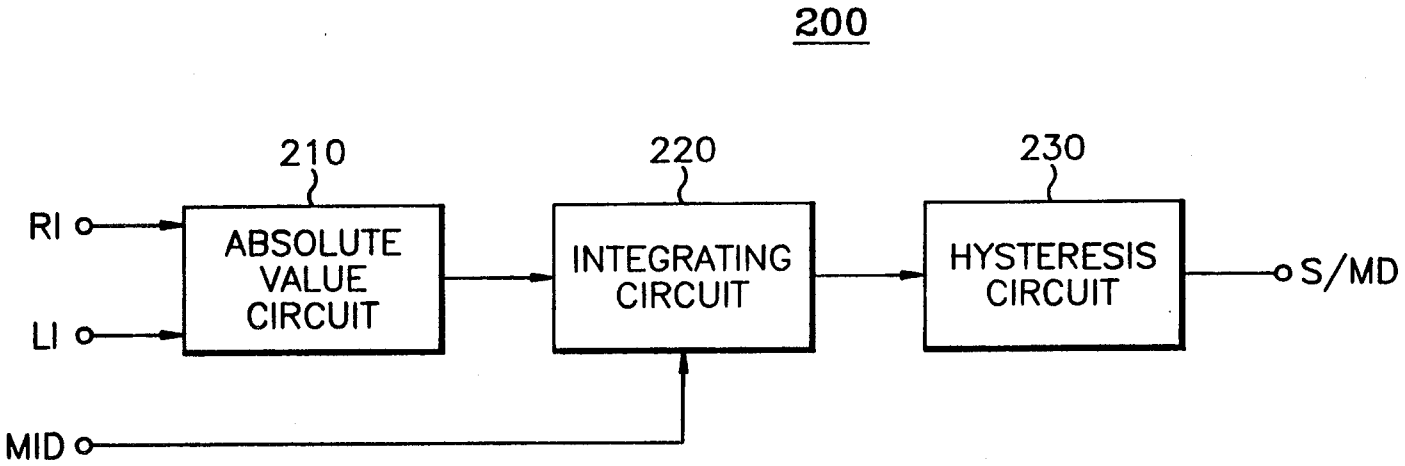
FIG. 4A is a schematic circuit block diagram for illustrating a stereophonic detector means of FIG. 2.
Figure 4B:
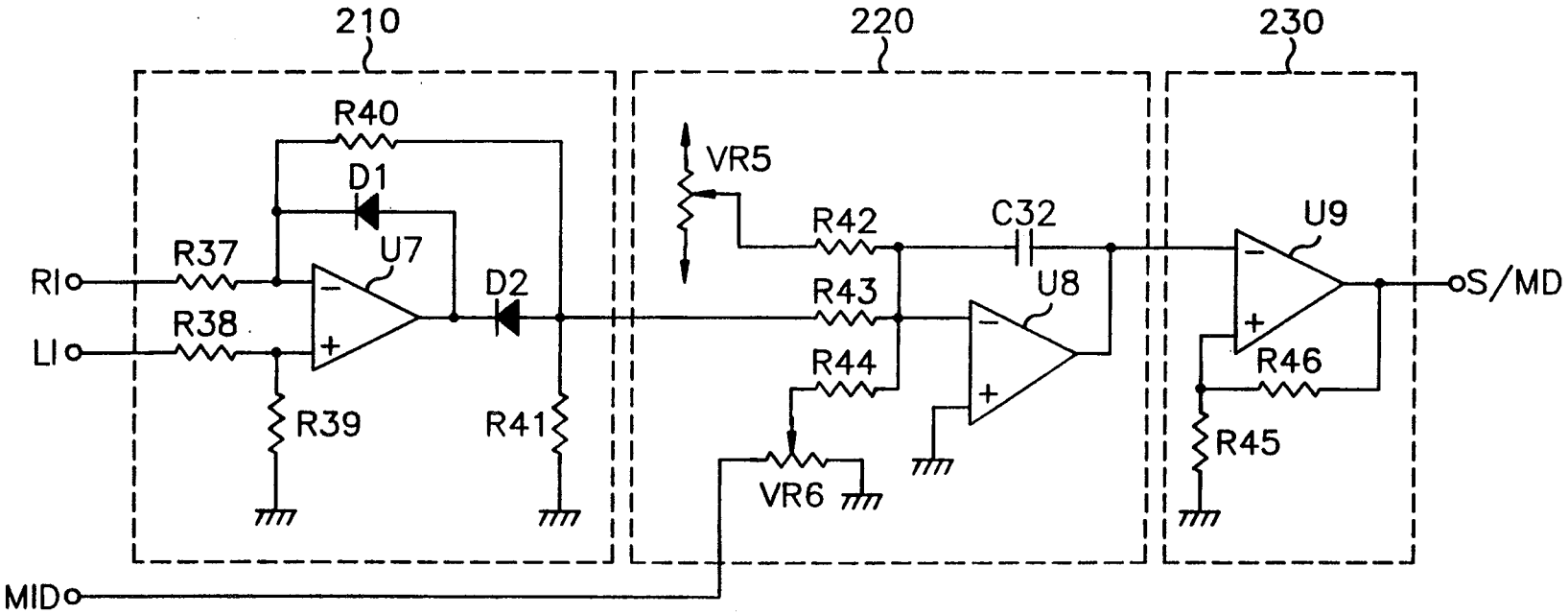
FIG. 4B is a schematic diagram of FIG. 4A.

With reference to FIGS. 4A and 4B, means 200 discriminates the audio signal as the musical or vocal signal. If the stereophonic audio signal contains the music components, the left and right channels have audio signals of different levels. However, the human voice signal is, nearly monophonic, loaded into both channels nearly in the same degree. An absolute value circuit 210 subjects the two audio signals RI and LI to a differential amplification, and takes the absolute value of the amplified signal. Namely, referring to FIG. 4B, the amplifier U7 of the absolute value circuit 210 produces the difference between the two input audio signals RI and LI, which difference is rectified to an absolute value by the diodes D1 and D2, which is applied to the minus side of the amplifier 7. The rectified signal is proportional to the input signals. If the audio signal is voice, both channels carry signals of nearly the same level, while if the audio signal is music, both channels carry signals of different levels. Thus, the differential amplifier U7 produces a difference signal of a given level in the case of the music signals, or does not produce the difference signal in the case of the voice signals.

An integrating circuit 220 integrates the absolute value of the difference signal together with the rectified signal MID of the voice component signal VO. The output of the integrating circuit 220 is low level in the case of voice, or high level in the case of music. The MID is the rectified signal of the voice component signal VO produced from the low and high detection circuit. Thus the integrating circuit 220 produces the signal obtained by abstracting the voice component signal having the intermediate frequency band from the difference signal of the left and right channels of the audio signals. Hence, the output of the integrating circuit 220 is high in the case of the music, or low in the case of the voice.

The output of the integrating circuit 220 is inverted through a hysteresis circuit 230. The hysteresis circuit 230 serves as the schmitt trigger via resistors R45 and R46 so as to control the quick discrimination of the audio signal as the voice or music.

In brief, the stereophonic detection circuit 200 produces a low signal for music or a high signal for voice, according to whether the audio signals RI and LI contain the stereo components. If the audio signal is monophonic and thus both channels carry the audio signal of the same level, it is preferable to disconnect the stereophonic detection circuit 200.

Figure 5A:
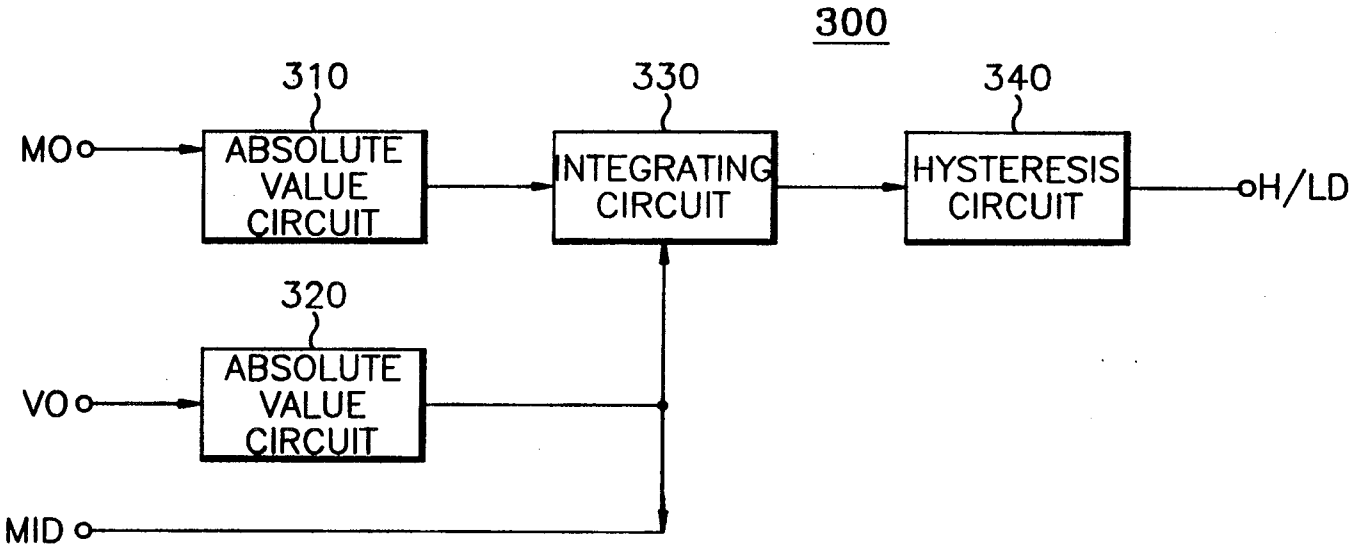
FIG. 5A is a block diagram for illustrating a detector means for detecting low and high frequency band signals as shown in FIG. 2.
Figure 5B:
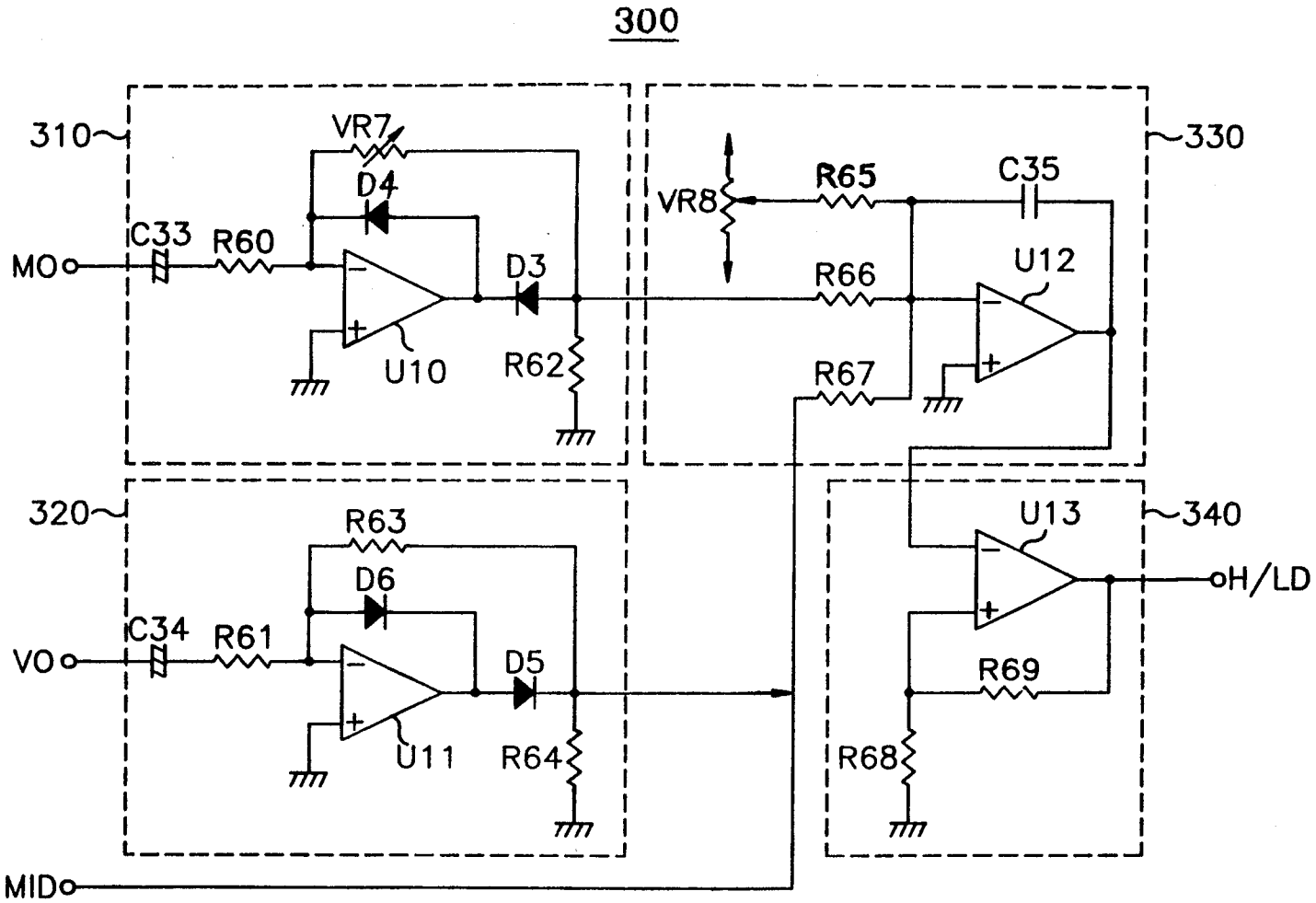
FIG. 5B is a schematic diagram of FIG. 5A.

FIGS. 5A and 5B, describe the operation of the low and high frequency detection circuit 300 for detecting the intensity of the low and high frequency bands of the audio signal.

The voice component signal VO is rectified to the positive side signal of amplifier U11 in the an absolute value circuit 320. Namely, the positive side waveform of the voice component signal VO is produced by the diodes D5 and D6. This signal is the MID signal applied to the integrating circuit 220 of the stereophonic detection circuit 200 and to the differential amplifier 420 of the intermittence detection circuit 400. This MID signal, as stated above, is the positive side rectified signal of the voice signal frequency band.

Further, the music component signal MO is rectified to the negative side of the amplifier U10 in an absolute value circuit 310, and thereby is transformed into an absolute value. Namely, the negative side waveform of the music component signal MO is outputted via diodes D3 and D4. Because the music component signal has the music components concentrated in the low and high frequency bands, the output of the absolute value circuit 310 is the reference signal in discriminating the audio signal as the music or voice. The variable resistor VR7 of the absolute value circuit 310 serves to enhance the music component signal MO compared to the MID signal, in case that the musical signal is detected.

The integrating circuit 330 integrates the two signals produced from the absolute value circuits 310 and 320, wherein the sound pressure difference of the music and voice is integrated so as to produce the music component signal of high intensity. Thus the integrating circuit 330 produces a high signal in the case of music, or low signal in the case of voice.

The output of the integrating circuit 330 is inverted through the hysteresis circuit 340, which serves as a schmitt trigger via resistors R68 and R69, so that in case of quick decision of the audio signal to the music or voice, the decision is periodically controlled.

Hence, the high and low frequency detection circuit 300 produces the low signal indicating music if the sound pressure of the low or high frequency band (i.e., the music component signal MO) is high, or produces the high signal indicating voice if the sound pressure of the intermediate frequency band (i.e., the voice component signal VO) is high.

Figure 6A:
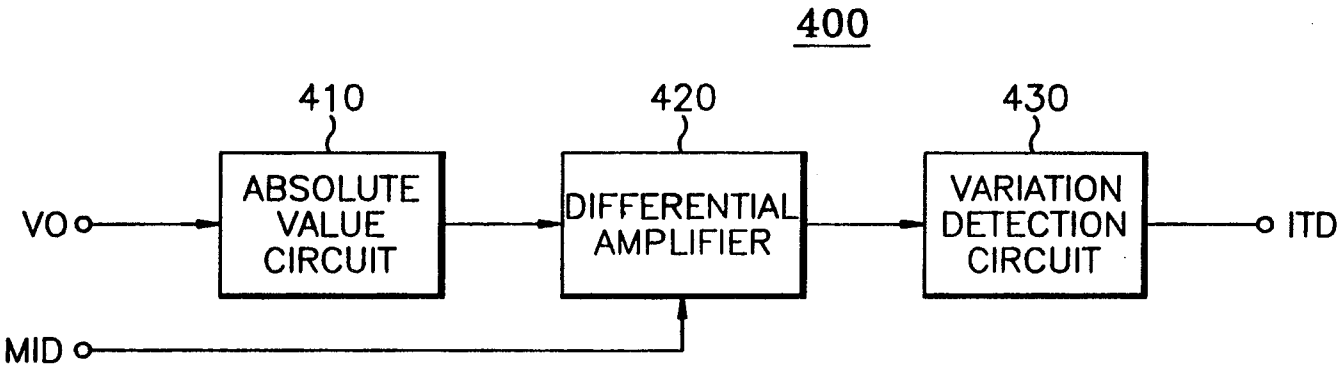
FIG. 6A is a block circuit diagram for illustrating a detector means for detecting the intermittence of an audio signal as shown in FIG. 2.
Figure 6B:
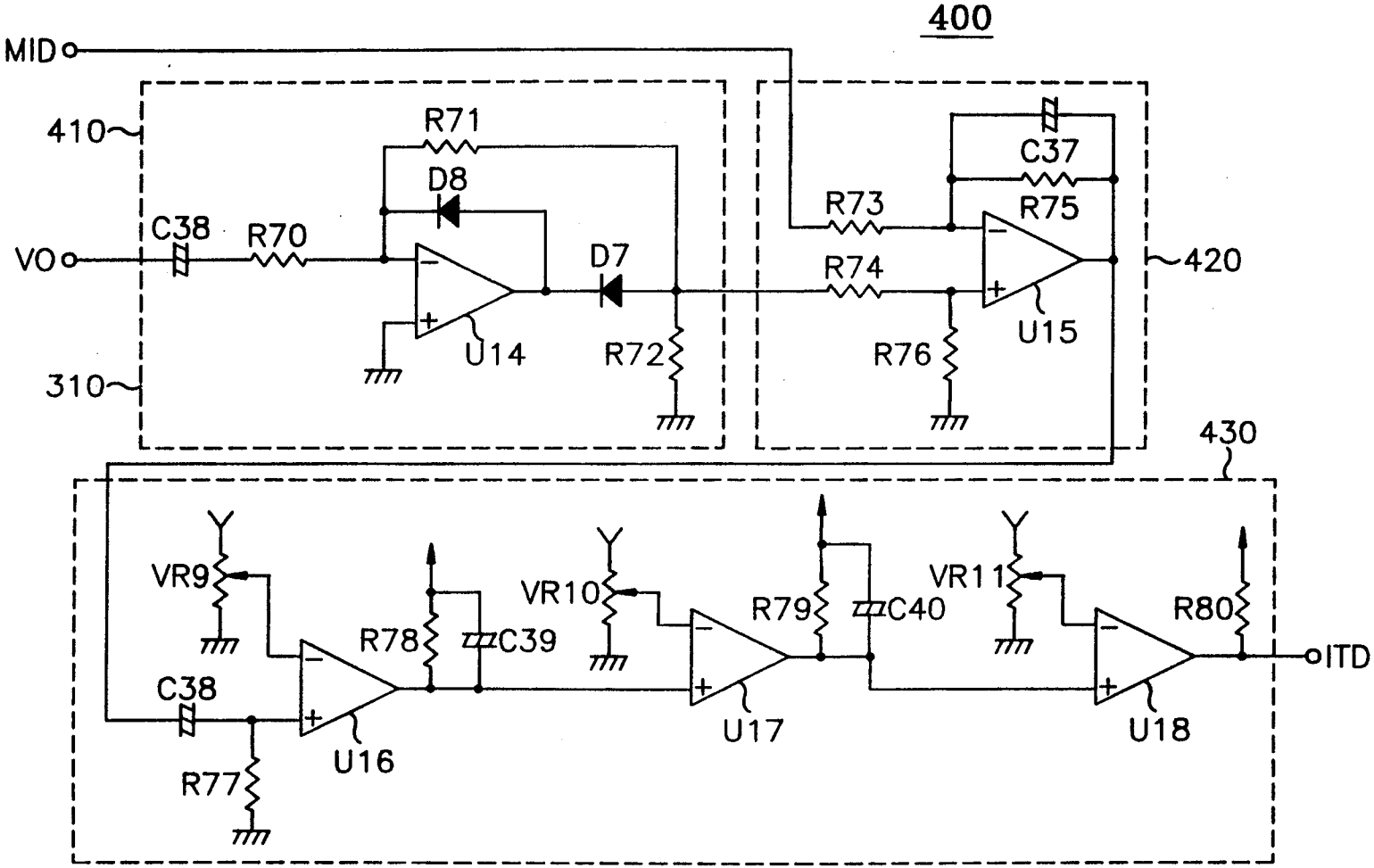
FIG. 6B is a schematic diagram of FIG. 6A.
Figure 6C:
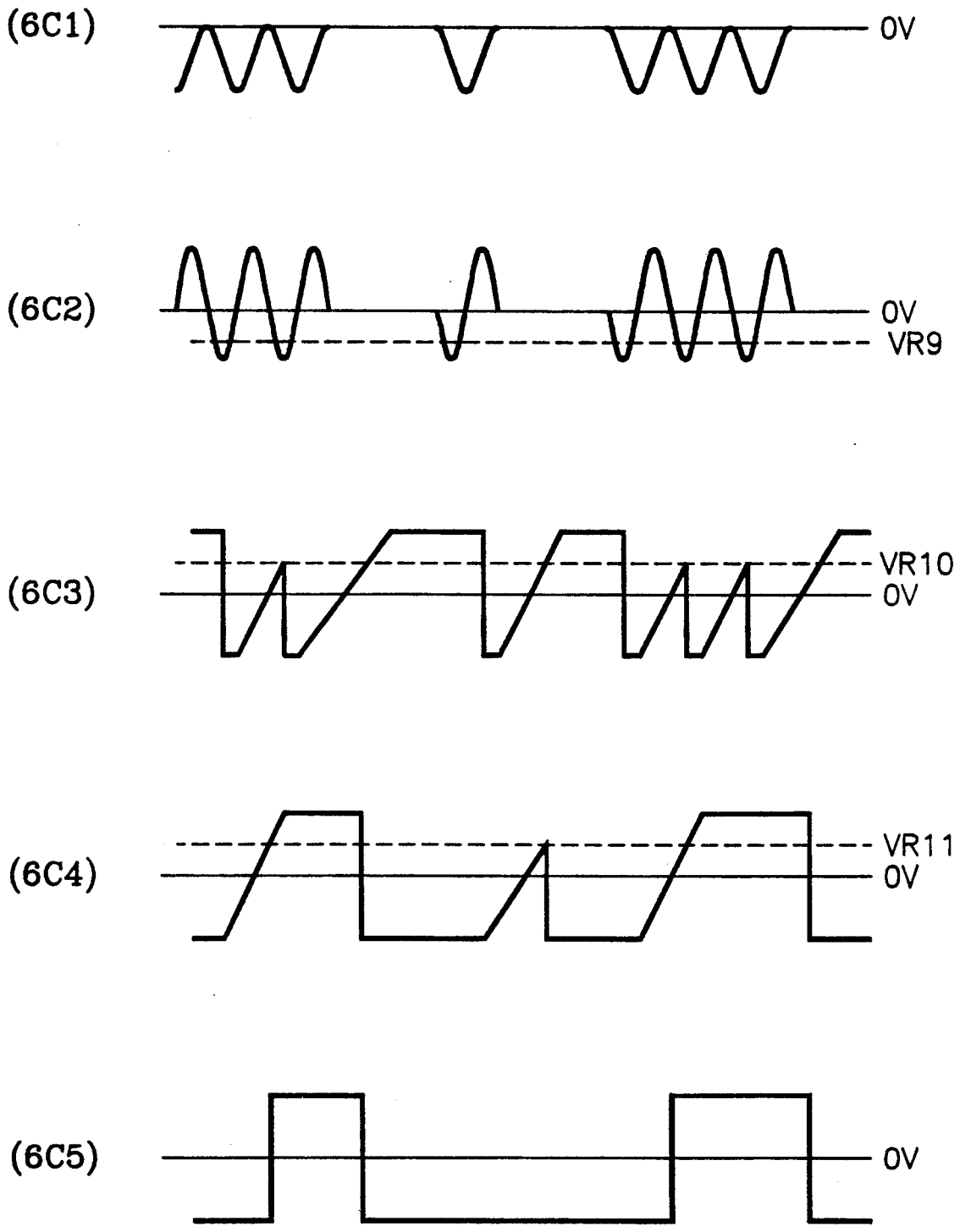
FIG. 6C is a waveform diagram of FIG. 6B.

FIGS. 6A, 6B and 6C, describes the operation of an intermittence circuit. Generally an envelope of the voice signal is longer than that of the music signal. Hence, the music signal has a greater intermittence than the voice signal. The absolute value circuit 410 transforms the voice component signal VO into an absolute value thereof, thus producing the negative side waveform signal of the voice signal. The differential amplifier 420 amplifies the difference between the output of the absolute value circuit 410 and the MID signal. In this case, the output of the absolute value circuit 410 is negative side output of the voice component signal VO, and the MID signal is the positive side output of the voice component signal VO. Thus, the differential amplifier 420 produces the full wave rectified signal of the voice component signal VO as shown in FIG. 6C1.

The variation detection circuit 430 analyzes the intermittence of the envelope signal as shown in FIG. 6C1 produced from the integrating circuit 420, thus discriminating the audio signal as the voice or music. The variation detection circuit 430, as shown in FIG. 6B, comprises a plurality of comparators U16 to U18, a plurality of variable resistors VR9 to VR11 for respectively providing a reference voltage to the comparators, a plurality of pull-up resistors R78 to R80, and capacitors C39 and C40. The pull-up resistors R78 and R79 are respectively connected to the outputs of the comparators U16 and U17, and connected to the capacitors C39 and C40 connected in parallel with the pull-up resistors R78 and R79. Thus the variation detection circuit 430 serves as a two-stage one shot multi-vibrator. Hence, the envelope signal as shown in FIG. 6C1 passes capacitors C38 and resistor R77 constituting a differential circuit, thus forming a signal as shown in FIG. 6C2. The differential signal as shown in FIG. 6C2 is compared to the reference signal established by the variable resistor VR9, through the comparator U16, thereby producing a compared signal as shown in FIG. 6C3, by the resistor R78 and capacitor C39. The compared signal as shown in FIG. 6C3 is compared to the reference signal established by the variable resistor VR10, through the comparator U17, thereby producing a compared signal as shown in FIG. 6C4, by the resistor R79 and capacitor C40. Finally the compared signal as shown in FIG. 6C4 is compared to the reference signal established by the variable resistor VR11, through the comparator U18, so that the variation detection circuit 430 produces a final signal as shown in FIG. 6C5. In this case, the first compared signal applied to the comparator U16 is determined to have −5V to 0V by the variable resistor VR9, the second compared signal applied to the comparator U17 is determined to have 0V to +5V by the variable resistor VR10, and the third compared signal applied to the comparator U18 is determined to have 0V to +5V by the variable resistor VR11. The comparators produce a high or low signal according to whether the audio signal is discriminated as the voice signal or the music signal.

Thus, the intermittence detection circuit 400 detects the intermittence of the envelope of the voice component signal VO transformed into an absolute value, thereby producing the signal indicating the voice or music according to whether the envelope is continuous or intermittent.

Figure 7A:
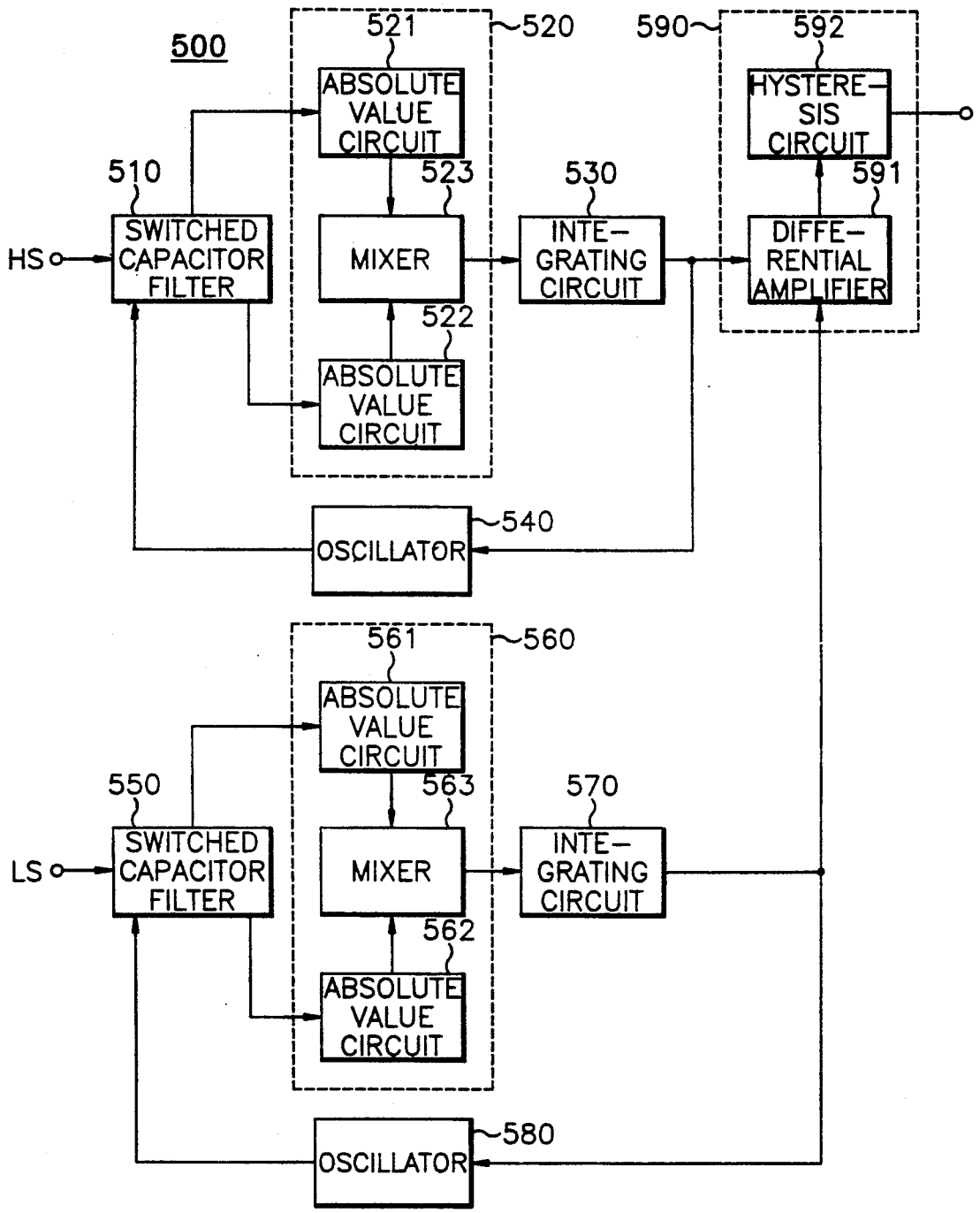
FIG. 7A is a block diagram for illustrating a detector means for detecting the peak frequency changes of an audio signal as shown in FIG. 2.
Figure 7B:
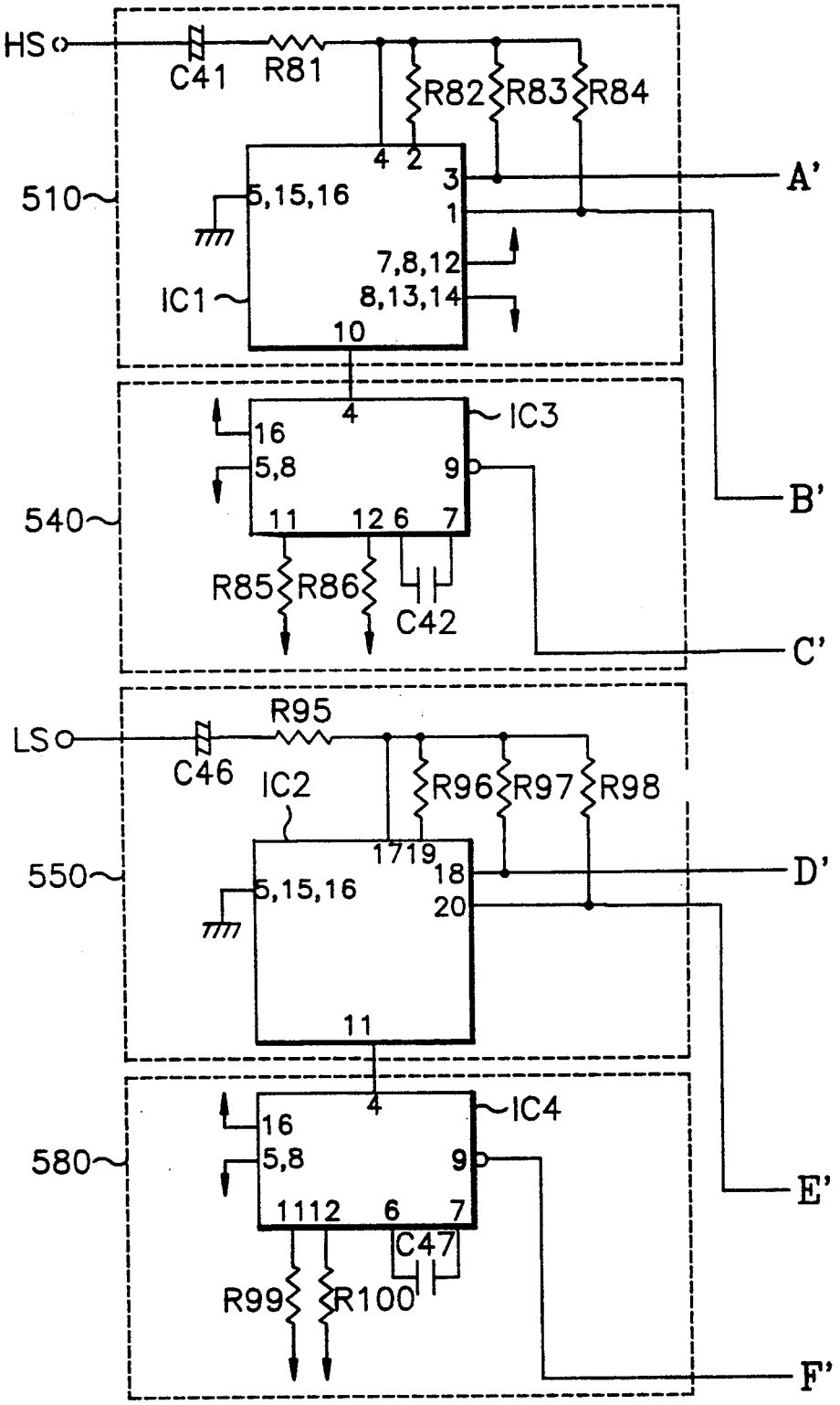
FIGS. 7B and 7C are schematic diagrams of portions of FIG. 7A.

FIGS. 7A and 7B described the operation of the peak frequency change detection circuit 500. The low and high frequency band music component signals HS and LS are respectively filtered by the switched capacitor filters 510 and 550. The input signal of the music component signals and the filtered signals are transformed into absolute values by means of the absolute value circuits 521, 522, 561 and 562. The absolute values are mixed in the mixers 523 and 563. The outputs of the mixers are respectively integrated by the integrating circuits 530 and 570 to produce voltage signals proportional to the input signals. The integrated signals are respectively applied to the oscillators 540 and 580 providing the control frequency to the switched capacitor filters 510 and 550. Furthermore, the integrated signals are applied to the differential amplifier 591, then producing the difference signal caused by the difference between the integrated signals. Then the difference signal is outputted, through the hysteresis circuit 592, as the peak frequency change signal of the difference detected frequency band.

Figure 7C:
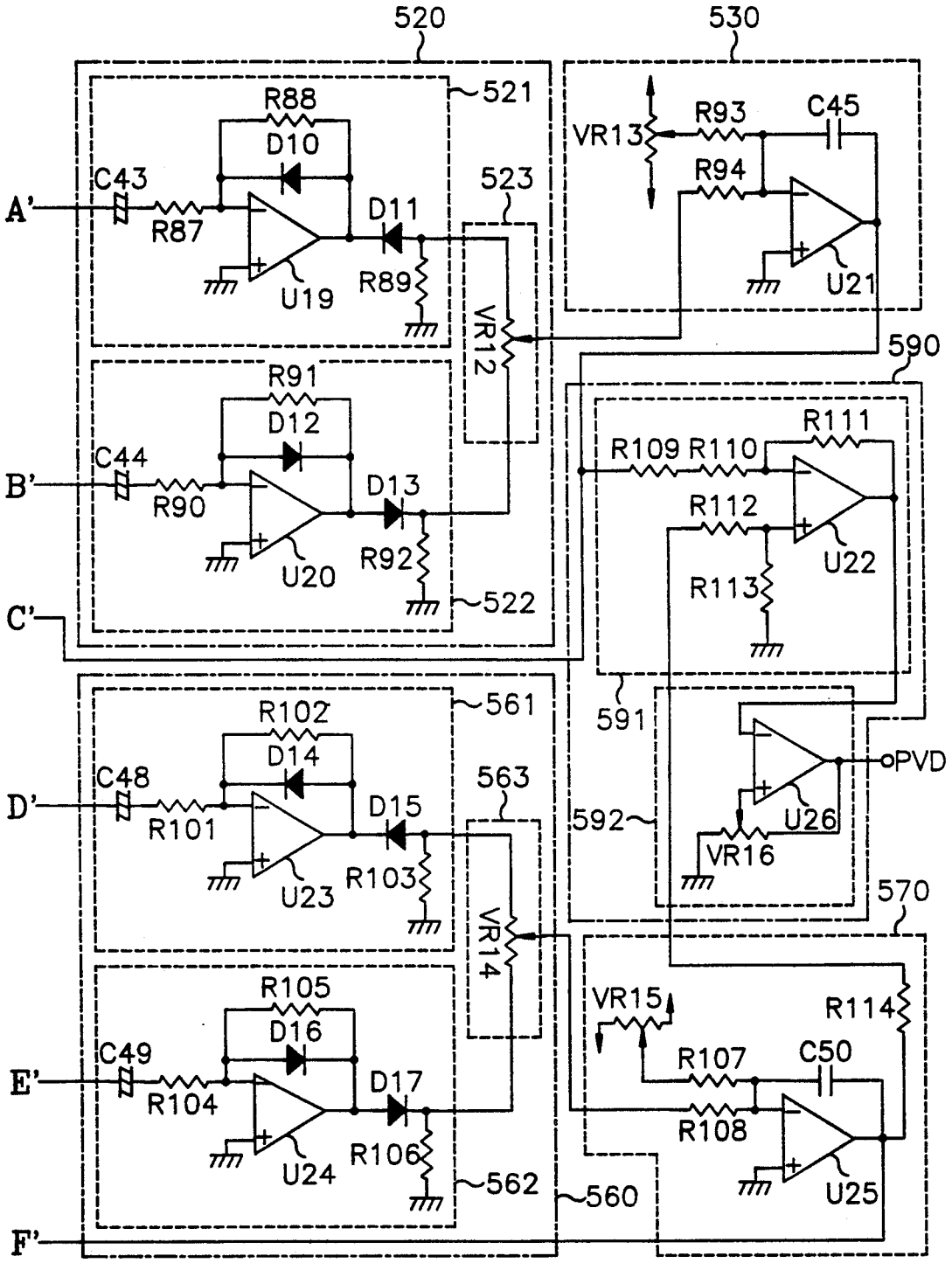

The switched capacitor filters 510 and 550 may be be part number MF10 manufactured by National Semiconductor Co., and the oscillators 540 and 580 may be be part number MC4046 manufactured by Motorola Co. The switched capacitor filters 510 and 550 have multiple operational modes, of which mode 3 is used in the inventive circuit. The cutoff frequencies of the filters serve as control frequencies for the low pass filter output and the high pass filter output of the state parameter filter. Hence, the switched capacitor filters IC1 and IC2, as shown in FIG. 7B, produce the received music component signal and the shifted, music component signal to a given frequency band. In FIG. 7C, the amplifiers U19, U20, U23 and U24 connected to the outputs of the switched capacitor filters IC1 and IC2 are in turn connected to the diodes D10 to D17 of the different polarities. Hence, the rectified signals having different polarities are respectively mixed in the variable resistors VR12 and VR14 to establish the high/low values. The voltage values established respectively by the variable resistors VR12 and VR14 are respectively applied to the integrating circuits 530 and 570. The integrating circuits 530 and 570 integrate the divided voltage defined by the high/low ratio, that is the sound pressure of the high frequency music component signal HS and low frequency music component signal LS, apply the integrated voltage to the oscillators IC3 and IC4 as the control voltage thereof. Then the oscillators IC3 and IC4 produce control frequency signals, and provides the control frequency signals respectively to the switched capacitor filters IC1 and IC2. The control voltages of the oscillators IC3 and IC4 are selected so that the working frequency is increased if the sound pressure of the high frequency band music component signal HS is high, and decreased if the sound pressure of the low frequency band music component signal LS is high.

As stated above, the bandwidths of the low and high frequency band signals LS and HS are detected, and the detected low and high frequency band signals LS and HS are applied to the differential amplifiers U22 to produce the difference signal. In this case, if the audio signal represents the music with the low or high frequency band containing the music components, the differential amplifier produces the signal of high level. However, if the audio signal only contains the voice component of the intermediate frequency band, the differential amplifier U22 produces the signal of low level. The output of the differential amplifier U22 is inverted by the inverter U26 that serves the schmitt trigger via the variable resistor VR16.

Hence, the peak frequency change detection circuit 500 produces the state signal indicating the ratio of the high frequency band sound pressure and the low frequency band sound pressure of the two input signals HS and LS being high/low, and determining the respective oscillation control voltage difference so as to detect the bandwidth of the input signal. Then finally the circuit 500 detects the peak frequency changes in the detected bandwidth, thus to discriminate the audio signal as the music or voice.

As stated above, the inventive apparatus analyzes the properties of the audio signal to produce a plurality of decision signals. The S/MD is the signal for indicating the stereo components of the audio signal to discriminate the audio signal as the music or voice. The H/LD is the signal for indicating the sound pressures of the low and high frequency bands to which belongs the music component. For example, if the sound pressures of the low and high frequency bands are high, the audio signal is discriminated as the music signal. The ITD is the signal for indicating the intermittence of the envelope of the audio signal. That is, if the intermittence is high, the audio signal is discriminated as the music, and if the high continuity is detected, the audio signal is discriminated as the voice. The PVD is the signal for indicating the peak frequency change in the bandwidths of the low and high frequency band music components, and if the peak frequency changes are great, the audio signal is discriminated as the music. In the present embodiment, the signals S/MD, H/LD, ITD and PVD are low or high according to the audio signal being discriminated as the music or voice, respectively.

Figure 8A:
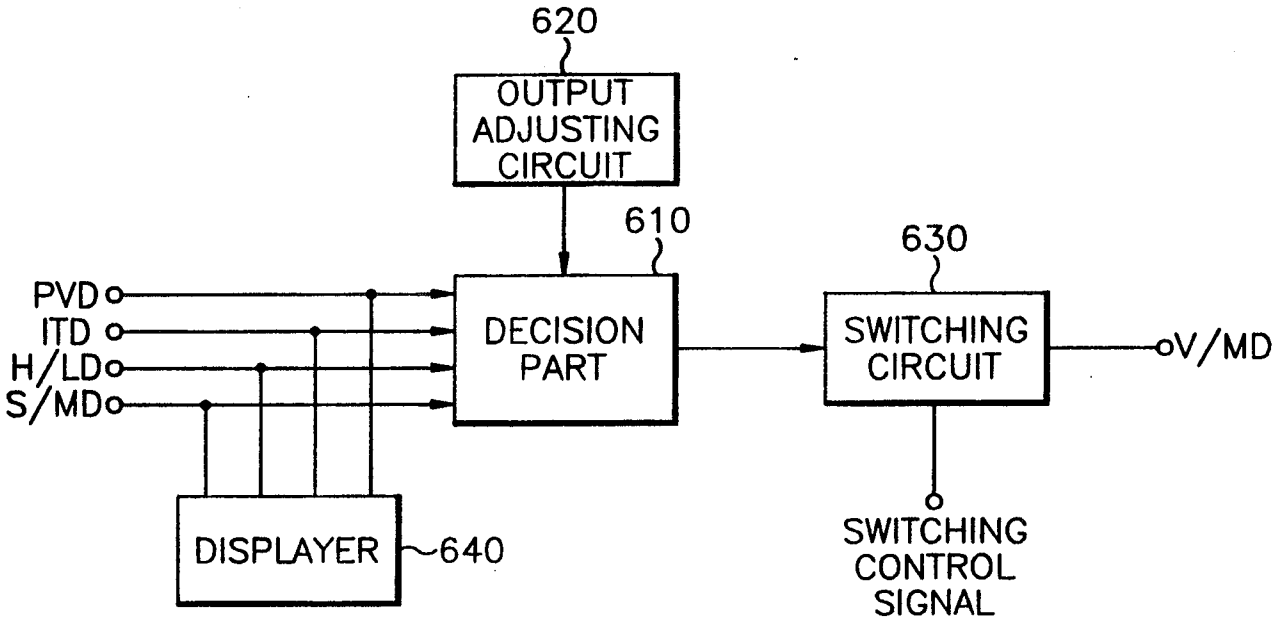
FIG. 8A is a block diagram for illustrating a final decision means.

However, since each of the decision units discriminates the audio signal as the music or voice based on inherent functional characteristics, a decision unit output may have a high instantaneous error rate. Accordingly, the final decision circuit 600 shown in FIGS. 8A and 8B systematically analyzes the decision signals of the decision units to produce a final decision signal V/MD.

Figure 8B:
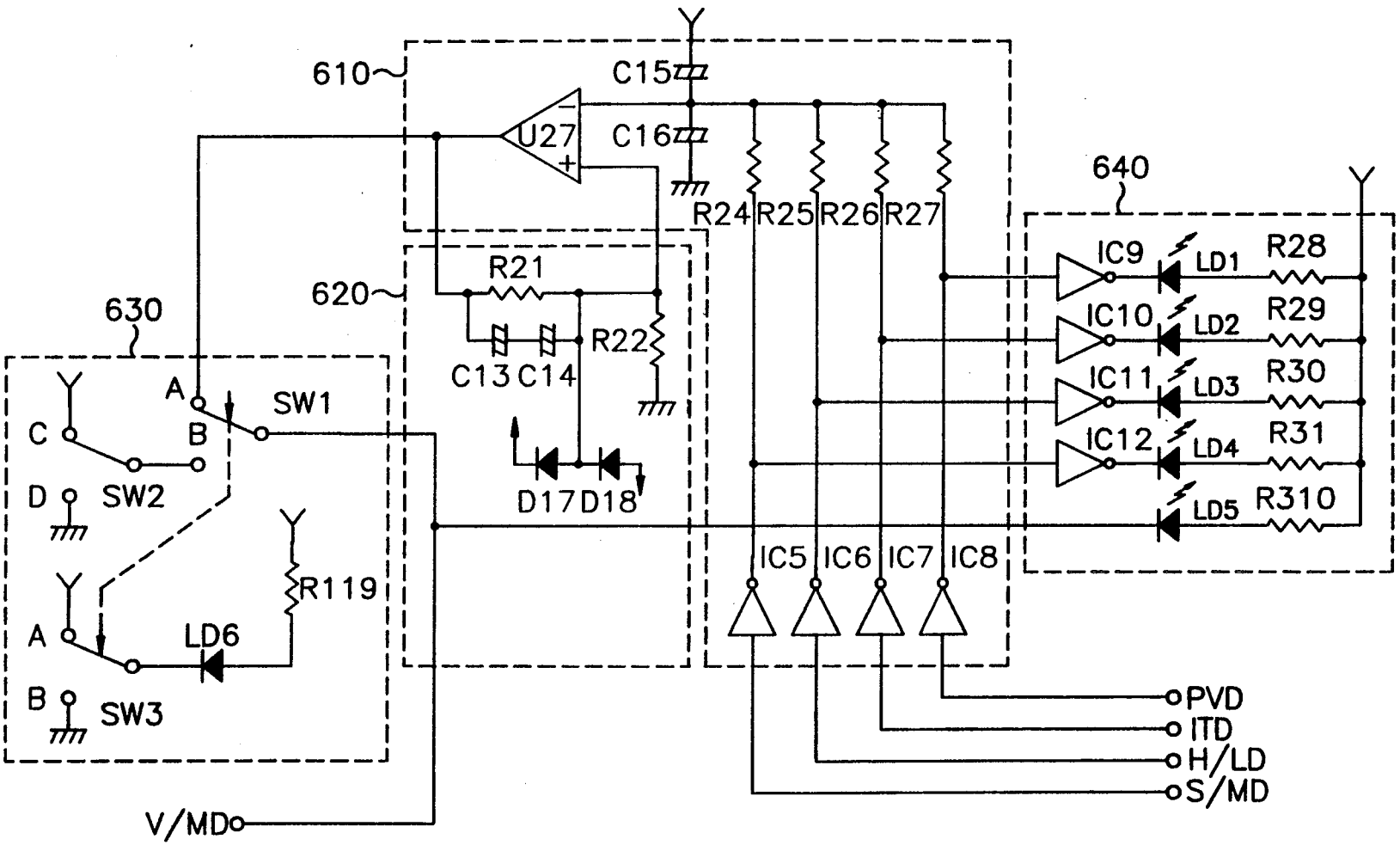
FIG. 8B is a schematic diagram of FIG. 8A.

The decision signals S/MD, H/LD, ITD, PVD are applied to the decision part 610 of the decision circuit 600 to finally decide the audio signal as the voice or music. Referring to FIG. 8B for illustrating the decision part 610, the decision signals are inverted by buffers IC5 to IC8, and are applied through resistors R24 to R27 to comparator U27. If the comparator U27 receives at least three decision signals indicating music, a final decision signal V/MD of low indicating a music signal is produced. However, if the comparator U27 receives at least two decision signals indicating a voice, the final decision signal V/MD of high state voice signal is produced.

Moreover, since the output of the comparator U27 is positively fed back by the loop resistors R21 and R22, the comparator 27 performs the schmitt trigger having hysteresis characteristics. The non-polarity capacitors C13 and C14 connected in parallel with the loop resistors R21 and R22 protect the previously charged voltages, by the time lock-out function, whenever the state of the output of the comparator changes. The state change occurs when the reference voltage of the comparator U27 is deviated from the center voltage. In this case, since the reference voltage is deviated from the source voltage by the predetermined value, the diodes D17 and D18 are connected to the comparator U27 to protect the comparator U27.

In the switching circuit 630, if the switch SW1 for selecting the operation of the inventive apparatus, is placed in the position A, the final decision signal V/MD is outputted from the comparator U27. At this time, the switch SW3 is also moved in connection therewith. However, if the switch SW1 is placed in the position B, the comparator U27 is disconnected, and therefore the switch SW2 is selectively moved to produce the signal of high or low.

Additionally, the decision signals produced from the buffers IC5 to IC8 are inverted via the buffers IC9 to IC12. Each of the light emitting diodes LD1 to LD5 is turned on if the corresponding decision signal is discriminated as the music.

Thus the final decision circuit 600 systematically analyzes the decision signals so as to finally discriminate the audio signal as the music or voice, thereby minimizing the instantaneous error rate.

Using the inventive apparatus provides a compact audio system with a capacity to make an effective reproduction of the music. The audio/video modifier means 700 as shown in FIGS. 9A and 9B boosts the low and high frequency bands of the audio signal when the final decision signal represents the music.

The boost circuits 710 and 720 boost the low and high frequency bands of the audio signals RI and LI. Namely, the amplifier U30 boosts the low frequency band of the RI signal via the resistors R3 to R6 and capacitor C3, and boosts the high frequency band thereof through capacitor C4 and resistor R7. The amplifier U31 boosts the low frequency band of the LI signal via the resistors R9 to R12 and capacitor C5, and the high frequency band of the LI signal via the capacitor C6 and resistor R13.

The audio signals produced from the boost circuit 710 and 720 and the original input signals are selected by the selectors 731 and 732 according to the output signal of the final decision circuit 600. Namely, the boosted output of the amplifier U30 and U31 are respectively supplied to the switches SW4 and SW6, and the input audio signals RI and LI are respectively applied to the switches SW5 and SW7. In this case, if the final decision circuit 600 produces the final decision signal indicating the music, the switches SW4 and SW6 are turned on, while, if producing the final decision signal indicating the voice, the switches SW5 and SW7 are turned on. Thus, if the final decision signal indicating music is produced, the low and high frequency band signals of the audio signal are boosted through the amplifiers U30 and U31. Alternatively, if the final decision signal indicates the voice, the input audio signals RI and LI produced from the input buffer 800 are selected without modification. In this case, the capacitors C11 and C12 and resistors R20 and R21 eliminate the pop noise caused by the abrupt switching of the switches SW4 to SW7 during the changing of the output state of the final decision circuit 600.

Consequently, the music signal produced from the output buffer 900 is dynamically reproduced with the boosted low and high frequency band regions, while the voice signal is flatly reproduced.

Each feature disclosed in this specification including any accompanying claims, abstract and drawings, may be replaced by alternative features serving the same, equivalent or similar purpose, unless expressly stated otherwise. Thus, unless expressly stated otherwise, each feature disclosed is one example only of a generic series of equivalent or similar features.

While the invention has been particularly shown and described with reference to the preferred specific embodiment thereof, it will be apparent to those who are skilled in the art that in the foregoing changes in form and detail may be made without departing from the spirit and scope of the present invention.

What is claimed is:

1. An apparatus for discriminating an audio signal as one of vocal sound and musical sound, said apparatus comprising:

pre-processing means for providing a vocal frequency band signal and a musical frequency band signal by separating said audio signal;

intermediate decision means, connected to said pre-processing means, for producing a plurality of decision signals respectively indicating whether the audio signal is one of said vocal sound and said musical sound, in response to detection of properties of said audio signal, said intermediate decision means comprising:

a first decision unit for producing a first decision signal by discriminating said audio signal as said vocal sound when said audio signal is monophonic;

a second decision unit for producing a second decision signal by desciminating said audio signal as said musical sound when said musical frequency band signal is detected having a sound pressure higher than a predetermined sound pressure;

a third decision unit for producing a third decision signal by discriminating said audio signal as said vocal sound when an envelope of said vocal frequency band signal is detected having an intermittence lower than a predetermined intermittence; and a fourth decision unit for producing a fourth decision signal by discriminating said audio signal as said musical sound when said musical frequency band signal comprises a predetermined bandwidth; and final decision means for producing a final decision signal indicating whether said audio signal is said one of said vocal sound and said musical sound by analyzing and comparing said first, second, third and fourth decision signals.

2. The apparatus as claimed in claim 1, wherein said pre-processing means comprises:

adder means for generating an added signal by adding a left channel signal and a right channel signal corresponding to said audio signal;

first detector means for detecting said vocal frequency band signal upon filtering the added signal within a predetermined bandwidth; and second detector means for detecting a low musical frequency band component and a high musical frequency band component in dependence upon the added signal, and generating said musical frequency band signal by mixing the low musical frequency band component and the high musical frequency band component.

3. The apparatus as claimed in claim 2, further comprising audio/video modifier means for boosting high and low frequency bands of the audio signal when said final decision signal indicates said musical sound.

4. The apparatus as claimed in claim 3, wherein said audio signal is an analog signal.

5. An apparatus for discriminating an audio signal as one of vocal sound and musical sound, said apparatus comprising:

pre-processing means for generating a vocal frequency band signal and a musical frequency band signal by separating said audio signal;

first decision means for producing a first decision signal discriminating said audio signal as said vocal sound when said audio signal is monophonic;

second decision means for producing a second decision signal discriminating said audio signal as said musical sound when said musical frequency band signal is detected having a musical frequency band comprising a low frequency band component and a high frequency band component, said musical sound of said musical frequency band having a sound pressure higher than a predetermined sound pressure;

third decision means for producing a third decision signal discriminating said audio signal as said vocal sound when an envelope of said vocal frequency band signal is detected having an indicator of non-continuity being lower than a predetermined parameter of non-continuity;

fourth decision means for producing a fourth decision signal discriminating said audio signal as said musical sound when said musical frequency band signal comprises a predetermined bandwidth; and final decision means for producing a final decision signal discriminating said audio signal as said one of said vocal sound and said musical sound by analyzing and comparing said first, second, third and fourth decision signals.

6. The apparatus as claimed in claim 5, further comprising audio/video modifier means for reproducing said audio signal when said final decision signal is discriminated as said vocal sound, and for boosting the high and low frequency bands of the musical sound when said final decision signal is discriminated as said musical sound.

7. The apparatus as claimed in claim 1, wherein said first decision unit of said intermediate decision means produces said first decision signal by discriminating said audio signal as said vocal sound when said audio signal is monophonic, and discriminating said audio signal as said musical sound when said audio signal is polyphonic.

8. The apparatus as claimed in claim 1, wherein said second decision unit of said intermediate decision means produces said second decision signal by discriminating said audio signal as said musical sound when said musical frequency band signal comprising a low frequency musical component and a high frequency musical component is detected having a sound pressure higher than a predetermined sound pressure, and discriminating said audio signal as said vocal sound when said musical frequency band signal comprising the low frequency musical component and the high frequency musical component is detected having the sound pressure not higher than the predetermined sound pressure.

9. The apparatus as claimed in claim 1, wherein said third decision unit of said intermediate decision means produces said third decision signal by discriminating said audio signal as said vocal sound when an envelope of said vocal frequency band signal is detected having an intermittence lower than a predetermined intermittence, and discriminating said audio signal as said musical sound when the envelope of said vocal frequency band signal is detected having said intermittence not lower than the predetermined intermittence.

10. The apparatus as claimed in claim 1, wherein said fourth decision unit of said intermediate decision means produces said fourth decision signal by discriminating said audio signal as said musical sound when said musical frequency band signal is detected having a predetermined bandwidth, and discriminating said audio signal as said vocal sound when said musical frequency band signal is detected not having said predetermined bandwidth.

11. A method for discriminating an audio signal as one of vocal sound and musical sound, comprising the steps of:

generating a vocal frequency band signal and a musical frequency band signal by separating said audio signal;

producing a plurality of decision signals by detecting a corresponding plurality of predefined properties of said audio signal, each of said plurality of predefined properties corresponding to one of said vocal sound and said musical sound; and producing a final decision signal indicating whether said audio signal is said one of said vocal sound and said musical sound by analyzing and comparing said plurality of decision signals.

12. The method of claim 11, wherein said generating step comprises:

generating an added signal by adding a left channel signal and a right channel signal corresponding to said audio signal;

detecting said vocal frequency band signal in response to the added signal; and detecting a low musical frequency band component, a high musical frequency band component and said musical frequency band signal comprising the low musical frequency band component and the high musical frequency band component, in response to the added signal.

13. The method of claim 11, wherein said step of producing said plurality of decision signals comprises:

producing a first decision signal of said plurality of decision signals by discriminating said audio signal as said vocal sound when said audio signal is monophonic;

producing a second decision signal of said plurality of decision signals by discriminating said audio signal as said musical sound when said musical frequency band signal is detected having a sound pressure higher than a predetermined sound pressure;

producing a third decision signal of said plurality of decision signals by discriminating said audio signal as said vocal sound when an envelope of said vocal frequency band signal is detected having an intermittence lower than a predetermined intermittence; and producing a fourth decision signal of said plurality of decision signals by discriminating said audio signal as said musical sound when said musical frequency band signal is detected having a predetermined bandwidth.

14. The method of claim 11, further comprising the steps of:

reproducing said audio signal when said final decision signal is produced indicating said audio signal is vocal sound; and boosting the musical frequency signal band comprising a high frequency band component and a low frequency band component, when said final decision signal is produced indicating said audio signal is musical sound.

15. The method of claim 11, wherein said step of producing said plurality of decision signals comprises:

producing a first decision signal of said plurality of decision signals by discriminating said audio signal as said vocal sound when said audio signal is monophonic, and by discriminating said audio signal as said musical sound when said audio signal is polyphonic.

16. The method of claim 11, wherein said step of producing the plurality of decision signals comprises:

producing a first decision signal of said plurality of decision signals by discriminating said audio signal as said musical sound when said musical frequency band signal comprising a low frequency musical component and a high frequency musical component is detected having a sound pressure higher than a predetermined sound pressure, and by discriminating said audio signal as said vocal sound when said musical frequency band signal comprising the low frequency musical component and the high frequency musical component is detected having the sound pressure not higher than the predetermined sound pressure.

17. The method of claim 11, wherein said step of producing said plurality of decision signals comprises:

producing a first decision signal of said plurality of decision signals by discriminating said audio signal as said vocal sound when an envelope of said vocal frequency band signal is detected having an intermittence lower than a predetermined intermittence, and by discriminating said audio signal as said musical sound when the envelope of said vocal frequency band signal is detected having said intermittence not lower than the predetermined intermittence.

18. The method of claim 11, wherein said step of producing said plurality of decision signals comprises:

producing a first decision signal of said plurality of decision signals by discriminating said audio signal as said musical sound when said musical frequency band signal is detected having a predetermined bandwidth, and by discriminating said audio signal as said vocal sound when said musical frequency band signal is detected not having said predetermined bandwidth.

19. A detector for detecting a vocal sound and a musical sound of an audio signal, said detector comprising:

a frequency band separator separating said audio signal into a vocal component and a musical component by separating the audio signal into a vocal frequency band and a musical frequency band;

a processor, connected to said frequency band separator, comprising a plurality of decision circuits for producing a plurality of corresponding decision signals, each of said plurality of decision signals indicating that the audio signal is one of said vocal sound and said musical sound; and a final decision circuit producing a final decision signal indicating whether said audio signal is said one of said vocal sound and said musical sound by analyzing and comparing said plurality of decision signals.

20. The detector of claim 19, wherein said plurality of decision circuits of said processor comprises:

a decision circuit for producing a first decision signal of said plurality of decision signals by discriminating said audio signal as said vocal sound when said audio signal is monophonic, and discriminating said audio signal as said musical sound when said audio signal is polyphonic.

21. The detector of claim 19, wherein said plurality of decision circuits of said processor comprises:

a decision circuit for producing a first decision signal of said plurality of decision signal by discriminating said audio signal as said musical sound when said musical frequency band signal comprising a low frequency musical component and a high frequency musical component is detected having a sound pressure higher than a predetermined sound pressure, and discriminating said audio signal as said vocal sound when said musical frequency band signal comprising the low frequency musical component and the high frequency musical component is detected having the sound pressure not higher than the predetermined sound pressure.

22. The detector of claim 19, wherein said plurality of decision circuits of said processor comprises:

a decision circuit for producing a first decision signal of said plurality of decision signals by discriminating said audio signal as said vocal sound when an envelope of said vocal frequency band signal is detected having an intermittence lower than a predetermined intermittence, and by discriminating said audio signal as said musical sound when the envelope of said vocal frequency band signal is detected having said intermittence not lower than the predetermined intermittence.

23. The detector of claim 19, wherein said plurality of decision circuits of said processor comprises:

a decision circuit producing a first decision signal of said plurality of decision signals by discriminating said audio signal as said musical sound when said musical frequency band signal is detected having a predetermined bandwidth, and by discriminating said audio signal as said vocal sound when said musical frequency band signal is detected not having said predetermined bandwidth.

24. A signal processing apparatus for identifying an audio signal as one of a voice audio signal and a non-voice audio signal, comprising:

pre-processor means for processing said audio signal to generate first and second processed signals;

first detector means for generating a first detected signal by detecting whether said audio signal is one of stereophonic and monophonic signals;

second detector means, coupled to receive said first and second processed signals, for generating a second detected signal by detecting an intensity of high and low frequency components of said audio signal;

third detector means, coupled to receive a first one of said first and second processed signals, for generating a third detected signal by detecting whether the intensity of the high and low components of said audio signal is continuous or intermittent;

fourth detector means, coupled to receive a second one of said first and second processed signals, for generating a fourth detected signal by detecting peak frequency changes in a spectrum of said audio signal; and decision means for generating a final decision signal identifying whether the input audio signal is one of said voice audio signal and said non-voice audio signal in dependence upon a determination of the majority of the first, second, third and fourth detected signal.

25. The signal processing apparatus as claimed in claim 24, further comprising audio/video modifier means for boosting high and low frequency bands of the input audio signal when said final decision signal represents said non-voice audio signal.

26. The signal processing apparatus as claimed in claim 24, wherein said pre-processor means comprises:

adder means for adding right and left channel components of said audio signal to produce an added signal;

voice detector means for filtering said added signal within a first predetermined bandwidth to detect said voice audio signal, said first predetermined bandwidth having a frequency band between 400 Hz and 1.6 MHz; and non-voice detector means for filtering said added signal within a second predetermined bandwidth to detect said non-voice audio signal, said second predetermined bandwidth having a frequency band between 200 Hz to 3.2 MHz.

27. The signal processing apparatus as claimed in claim 24, wherein said first detector means comprises:

absolute value means for obtaining absolute values of right and left channel components of said audio signal and comparing the absolute values of the respective right and left channel components of said audio signal to produce a difference signal;

integrator means for integrating said difference signal to produce an integrated signal in dependence upon a rectified signal; and hysteresis means for enabling detection of whether said integrated signal is one of said voice audio signal and said non-voice audio signal.

28. The signal processing apparatus as claimed in claim 24, wherein said second detector means comprises:

absolute value mans for obtaining absolute values of said first and second processed signals to produce first and second reference signals;

integrator means for integrating said first and second reference signals to produce an integrated signal in dependence upon a rectified signal; and hysteresis means for enabling detection of whether said integrated signal is one of said voice audio signal and said non-voice audio signal.

29. The signal processing apparatus as claimed in claim 24, wherein said third detector means comprises:

absolute value means for obtaining an absolute value of said first one of said first and second processed signals to produce a reference signal;

differential amplifier means for amplifying a difference between said reference signal and a rectified signal to produce an amplified signal; and variation detector means for enabling detection of whether said amplified signal is one of said voice audio signal and said non-voice audio signal by analyzing the envelope of said amplified signal.

30. The signal processing apparatus as claimed in claim 24, wherein said fourth detector means comprises:

switched capacitor filter mean for filtering high and low frequency components of said second one of said first and second processed signals in dependence upon an control frequency;

means for obtaining absolute values of the outputs of said switched capacitor filter and combining the absolute values to produce voltage signals proportional to the high and low frequency components;

integrator means for integrating said voltage signals to produce first and second integrated signals; and means for producing a difference signal in dependence upon said first and second integrated signals and detecting peak frequency changes in the spectrum of said difference signal.

* * * * *

UNITED STATES PATENT AND TRADEMARK OFFICE

CERTIFICATE OF CORRECTION

PATENT NO. : 5,298,674
DATED : March 29, 1994
INVENTOR(S) : YUN

It is certified that error appears in the above-indentified patent and that said Letters Patent is hereby corrected as shown below:

| | | |
|---|---|---|
| Column 2, | line 28, | delete "schematic circuit". |
| Column 3, | line 45, | delete "have". |
| Column 4, | line 2, | delete "by momentarily driving each of the decision units, may be obtained". |
| | line 65, | Change "the" to --a--. |
| Column 5, | line 14, | delete "L and R". |
| Column 8, | line 11, | change "pas" to --pass-- |
| | line 42, | delete "level". |

UNITED STATES PATENT AND TRADEMARK OFFICE

CERTIFICATE OF CORRECTION

PATENT NO. : 5,298,674
DATED : March 29, 1994
INVENTOR(S) : YUN

It is certified that error appears in the above-indentified patent and that said Letters Patent is hereby corrected as shown below:

line 43, before "means", insert --a stereophonic detector--.

Column 10, line 32, change "capacitors" to --capacitor--.

line 65, change "described" to --describe--.

Column 18, line 10, change "signal" to --signals--.

Column 20, line 4, change "meas" to --means--.

Signed and Sealed this
Sixth Day of June, 1995

*Attest:*

*Attesting Officer*

Bruce Lehman

BRUCE LEHMAN

*Commissioner of Patents and Trademarks*